US005806314A

United States Patent [19]

Younes

[11] Patent Number: 5,806,314

[45] Date of Patent: Sep. 15, 1998

[54] PRESSURIZED CYLINDER AND BOOSTER IN A LOW VOLUME PRESSURE CIRCUIT

[75] Inventor: Joseph F. Younes, 205 Sewall St., Augusta, Me. 04330

[73] Assignee: Joseph F. Younes, Augusta, Me.

[21] Appl. No.: 749,551

[22] Filed: Nov. 15, 1996

Related U.S. Application Data

[63] Continuation-in-part of Ser. No. 538,567, Oct. 3, 1995, abandoned.

[51] Int. Cl.[6] ..... B60T 13/00

[52] U.S. Cl. ..... 60/547.1; 92/165 R; 92/166; 92/151

[58] Field of Search ..... 92/165 R, 151, 92/142, 166, 137; 60/563, 547.1, 593

[56] References Cited

U.S. PATENT DOCUMENTS

| | | | |
|---|---|---|---|
| 3,430,539 | 3/1969 | Freeman | 92/151 |
| 5,375,417 | 12/1994 | Barth | 60/370 |
| 5,542,939 | 8/1996 | Onodera et al. | 92/59 |

OTHER PUBLICATIONS

*Boosters* by Miller Fluid Power.

*Primary Examiner*—Thomas E. Denion

[57] ABSTRACT

A pressure-driven cylinder having a piston sliding within a sealed housing chamber between a pair of opposed side-end walls in a piston chamber. At least one chamber wall has a moveable portion of an end wall integrally connected to and axially spaced away from a pressure-driven face of the piston by an integral connector point that is much smaller in area than the piston's pressure face. That moveable wall portion acts as an integrally connected piston follower that has its own extended surface area that is progressively introduced into the presure chamber as the piston slides in order to reduce the required volume of pressurized driving fluid in the piston chamber. A chamber for the follower itself is sealably isolated from the piston chamber so that no driving fluid backs into the follower chamber. Both the end wall/follower and the piston reciprocate together. A booster of like construction and operational principles is coupled in several hydraulic circuits including a circuit for establishing a two-stroke engine.

18 Claims, 21 Drawing Sheets

PRESSURIZED CYLINDER AND BOOSTER IN A LOW VOLUME PRESSURE CIRCUIT

BACKGROUND OF THE INVENTION

The present application is a continuation-in-part of an application having Ser. No. 08/538,567 filed Oct. 3, 1995 now abandoned by the same inventor.

FIELD OF THE INVENTION

The field of this invention relates to sealed cylinders and pressure circuits for such cylinders. More particularly the field of the invention includes boosters and pistons in combination in pressurized systems for fluids such as hydraulic oil or air.

Patents cited in the parent application include U.S. Pat. No. 3,430,539 to R. B. Freeman, U.S. Pat. No. 772,842 to G. M. Spencer et al, U.S. Pat. No. 1,031,528 to C. H. Cole; U.S. Pat. No. 3,480,200 to D. F. Rohrer, U.S. Pat. No. 5,016,522 to Allardin and Japanese 0204304 to Kawasaki et al. Boosters are known and are described, for example, in a catalog entitled "Boosters" published by Miller Fluid Power and having File 8310 089112.

The above-noted references reveal that various cylinders and cylinder/booster combinations have been proposed wherein a piston in a sealed housing is driven by pressurized fluid. Normally the motion of a moving piston is translated to a connecting rod which is moved as the piston is driven by pressurized fluid—either hydraulic or air pressure. The above-noted publications describe a cross-section of the relevant art, and are generally characterized by complex porting arrangements and a high volume of driving fluid. This invention use a novel operating principle that eases the porting problems greatly while simultaneously reducing the volume of driving fluids that are required in various operating systems.

In the case of a hydraulic cylinder, the piston rod is slidably mounted through an end wall of a cylinder; and, in the case of the booster, a ram has a diameter smaller than that of the piston. A piston/ram is slidably mounted in a walled cylindrical part extending axially of the cylinder—which part is usually called the pressure chamber. In the chamber, fluid pressure from a source is developed or intensified. Such pressure acts upon a piston/ram in a working cylinder.

While the cylinders of the prior art have been satisfactory for their intended purpose, they have been generally characterized by a relatively high volume of hydraulic fluid required against the face of the piston to produce the required actuating pressure.

After considerable research and experimentation, the piston and booster of the present invention have been devised wherein a novel piston/ram assembly is constructed and arranged such that a relatively low volume of hydraulic fluid is required while performing the same work as a conventional piston or a piston and booster combination.

SUMMARY OF THE INVENTION

The cylinder of the present invention comprises a sealed housing having a piston slidably mounted therein and driving a connecting rod extending outside of the chamber for work to be performed. Such work can take the form of a linear or rotary system as described later herein. On a piston face opposite the work-delivering connecting rod is a slidable and integrally-connected piston follower. That follower serves both as a slidable part of a side end wall for the sealed chamber and also acts as in integral part of the piston itself.

It is sometimes hereinafter referred to as a partial end wall follower, a piston follower or simply a follower.

The purpose of the partial end wall follower, as it slides, is to occupy a significant part of the pressure chamber while requiring only a very limited space for its connection to the piston face. Thus, a piston for the invention has essentially the same pressure face area as the prior art, but reduces significantly the volume of the pressurized driving fluid in the sealed chamber. Thus, less hydraulic oil, air etc. is required per system.

In accordance with my invention a first slidable part of the side end wall of the chamber not only acts as a piston follower but reduces the porting requirements for such cylinders. In some embodiments the piston follower acts as a slidable double-sided potion of the end wall for the chamber. In this latter event the followers are positioned on the opposite sides of the piston, again have a smaller diameter than the main pressure-receiving face for the piston, and are axially spaced away but connected to the piston.

The preferred form for the housing is cylindrical with axially extending pressure-impervious faces for a cylindrical piston and equally impervious follower parts located on opposite sides of the piston face. Connection of the follower to the piston may be an integral stem that is screwed or cast thereto, or links which connect the followers to the piston faces at points that are smaller in diameter than both the piston and the followers.

In some embodiments an annular channel is provided in each face of the piston to add an extra depth only, while still allowing the driving fluid pressure to be exerted on the area of the piston surrounding the stem/link connection point. The volume of driving fluid compared to the prior art is decreased. Hydraulic fluid, such as hydraulic oil, acts against substantially the entire face of the piston, with less volume of hydraulic fluid being required than for a conventional hydraulic or booster cylinder.

A piston rod can be connected to one slidable solid part of an end wall follower in order to provide a working hydraulic cylinder. A plunger or ram can be connected to the piston follower wherein a ram is slidably mounted in a booster pressure chamber to form a booster. Also, the hydraulic cylinder/booster housing of the present invention may have one or more booster/piston/hydraulic cylinder combinations in a single housing depending upon the particular system application at issue.

BRIEF DESCRIPTION OF THE DRAWINGS

FIG. 28 shows a sectional side elevation view of a hydraulic cylinder and booster of the present invention installed as one piece and shown in a retracting position, and also showing a distribution chamber located in between;

Figure 1:
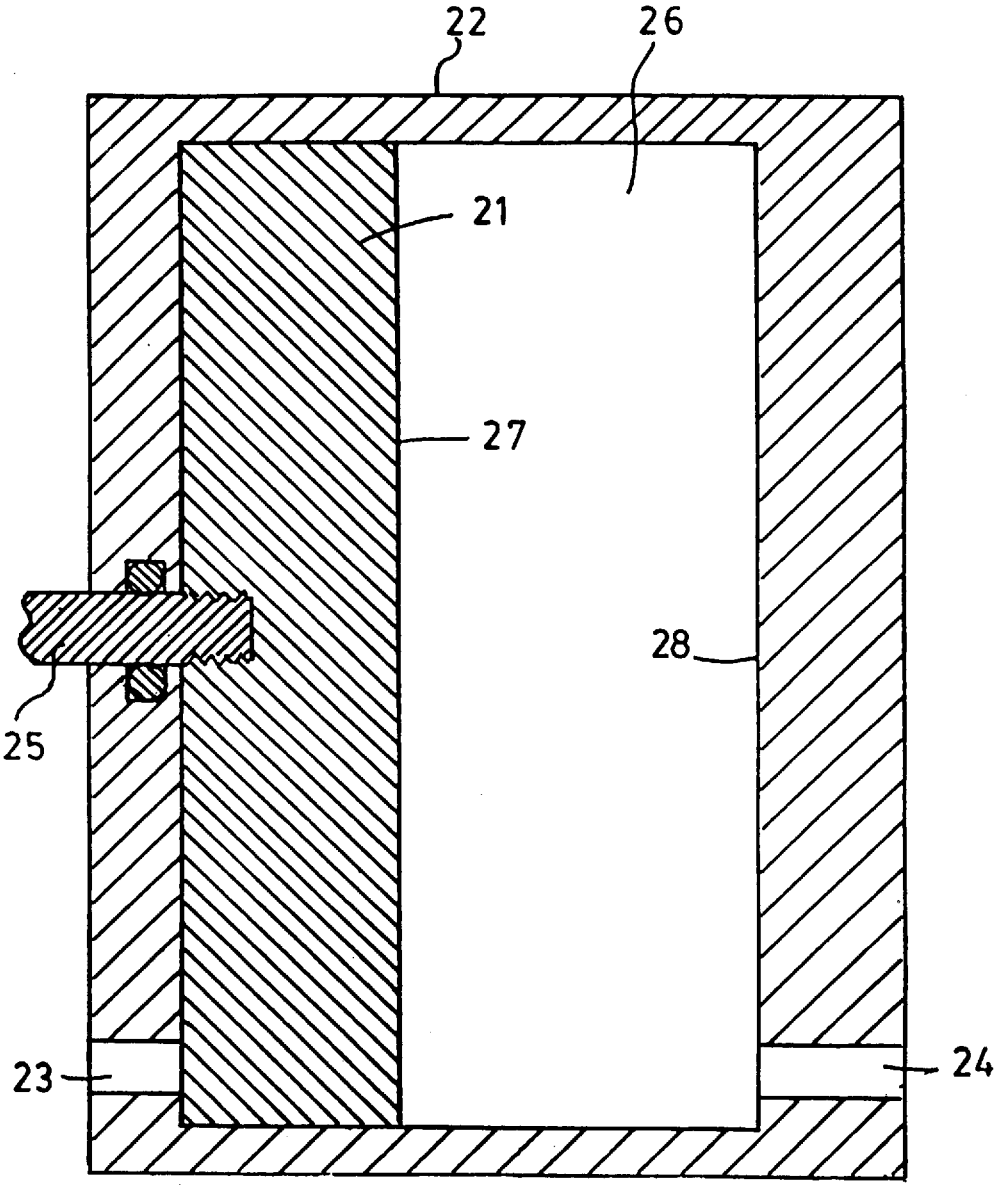
FIG 1 PRIOR ART
FIG. 1 is a sectional side elevation view of a conventional prior art piston/rod cylinder.

DESCRIPTION OF THE PREFERRED EMBODIMENT:

Referring to the drawings and, more particularly, to the prior art cylinder of FIG. 1, a piston 21 having an impervious face 27 is shown slidably seated in a chamber 26 within housing 22. Located through the opposing end walls of chamber 26 are inlet and outlet ports 23 and 24. Supply and/or exhaust of pressurizing fluid—such as hydraulic oil or air—is introduced into or exited from chamber 26 via these ports 23 and 24. Such ports are conveniently located in the end walls in order to cause movement of piston 21, which piston movement is translated into a linear movement of connecting rod 25. Rod 25 is connected outside of housing 22 in order to do external work.

Figure 2:
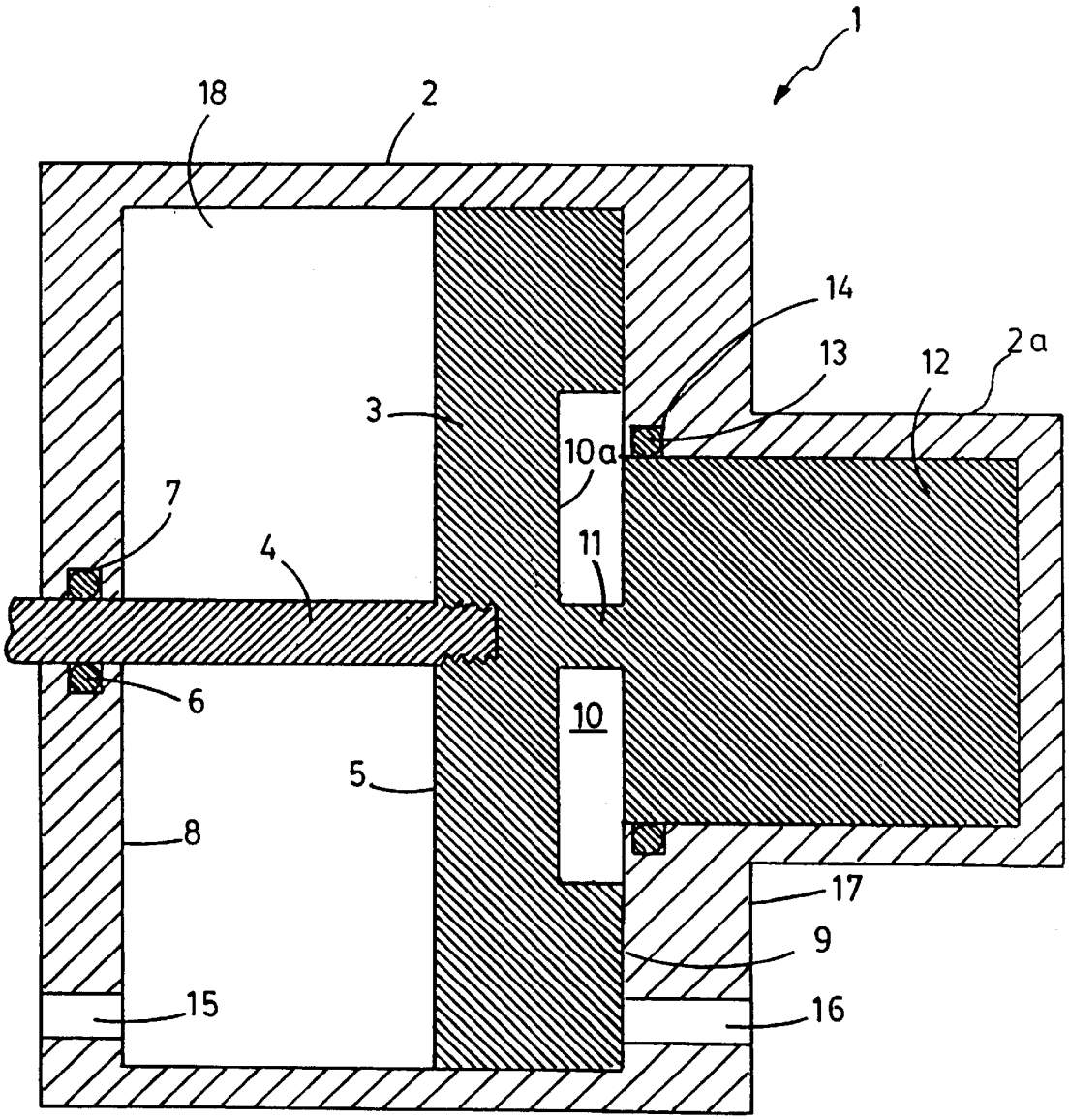
FIG. 2 is a sectional side elevation view of a cylinder with a piston in a retracted position and illustrating the basic piston/rod follower inventive feature of the present invention.

FIG. 2 depicts the improved hydraulic cylinder 1 of the present invention which comprises a housing 2 which preferably may be cylindrical in form. Housing 2 includes an inner pressure chamber 18 which has a piston 3 slidably mounted therein. A piston rod 4 is connected to one face 5 of piston 3 and is slidably mounted through an O-ring 6 mounted in a recess 7 provided in an end wall 8 of the cylindrical housing 2.

In FIG. 2, the opposite face 9 of the piston 3 is provided with an annular channel 10 surrounding a stem part 11 integral with the piston 3 and connected to a piston follower 12. Piston follower 12, it should be noted, also forms a first slidable part of a side end wall 17 of housing 2. Follower 1 2 has a smaller diameter than the piston 3 and has a larger diameter than that of stem 11 and is slidably mounted in the side end wall 17.

The cylinder housing 2 of the invention also includes an extra extended cylindrical surface 2*a* of the side end wall 17. An O-ring seal 13 is mounted in an annular recess 14 provided in the side end wall 17 of the cylindrical housing 2. Hydraulic fluid inlet and outlet ports 15 and 16 are provided in the end walls 8 and 17 of the cylindrical housing 2 of FIGS. 2 and 3.

Figure 3:
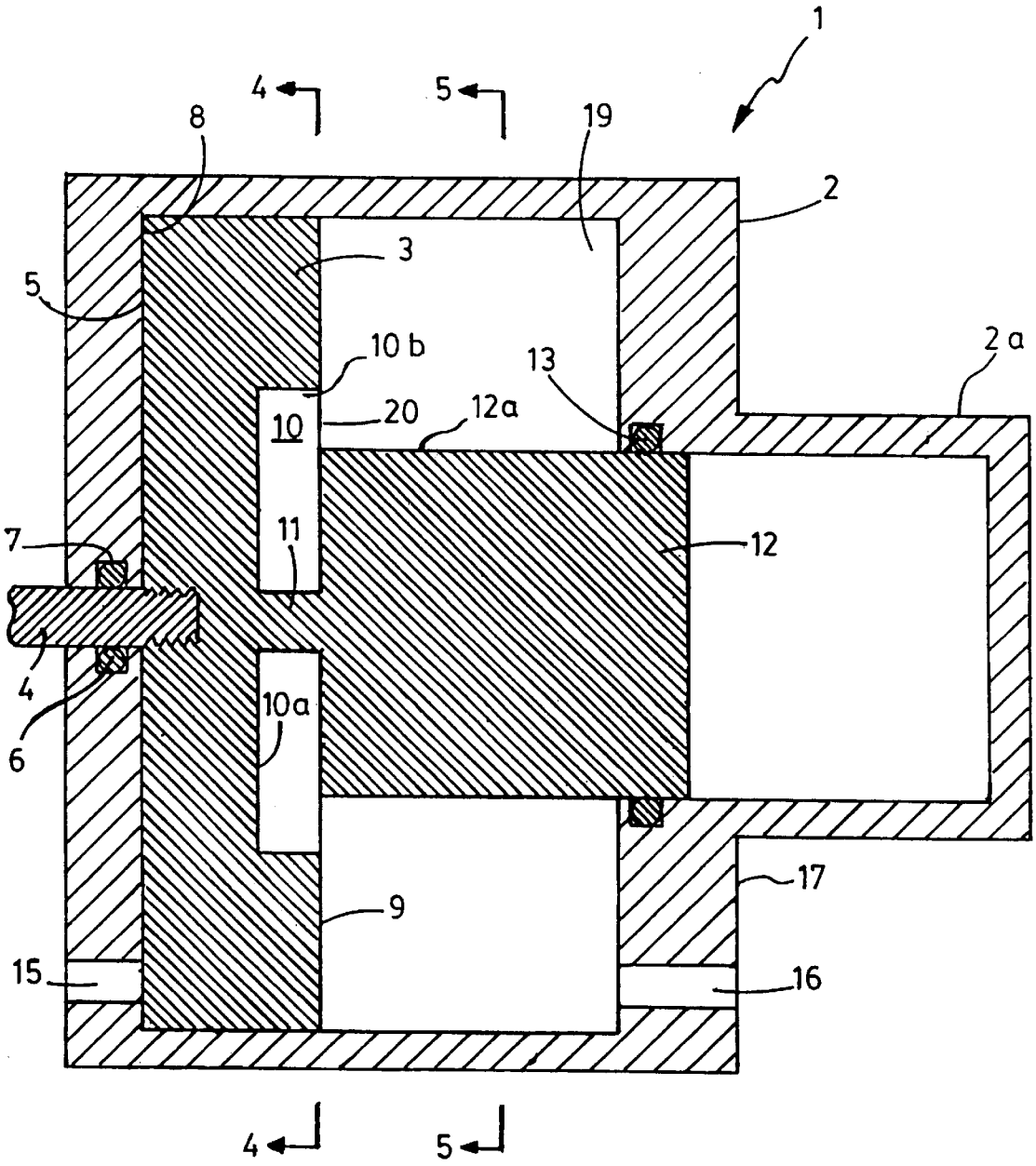
FIG. 3 is a sectional side elevation view of the novel cylinder shown in FIG. 2, with the piston and follower in an extended position.

The hydraulic cylinder shown in FIG. 2 is in the retracted position within a chamber 18 as defined by the cylindrical housing 2. When hydraulic fluid under positive pressure enters the cylindrical housing through port 16, that pressure is applied against an impervious face of piston 3 which responds by a sliding movement toward the advancing position as shown in FIG. 3. Accordingly, an associated piston rod 4 is also moved to the extended position as shown in FIG. 3. Hydraulic fluid which may have previously been contained in chamber 18 would have been exhausted by such piston movement through exit port 15.

While in the extended position as shown in FIG. 3, a selective application of pressurized fluid at port 15 may also drive the piston 3 back to the other side as shown in FIG. 2. In FIG. 3, positive pressure hydraulic fluid introduced into cylinder 1 through port 15 will thereby move the piston 3 and its follower 12—which is a slidable solid part of the side end wall 17—to the initial starting position of FIG. 2. Any earlier hydraulic fluid in chamber 19 will thus be exhausted through port 16 as earlier described.

When pressurized hydraulic fluid enters ports 15 or 16 such hydraulic fluid acts directly on the faces 5 or 9 of the piston 3. In FIG. 2, piston 3 has an annular channel 10 on face 9 in order of adding an extra oil depth only allowing the fluid pressure to be exerted on the area 10*a* surrounding the stem 11 which is located opposite the piston follower 12. The outer cylindrical surface 12*a* of follower 12 is impervious. It also should be understood that the follower 12 is shown solid but could be hollow so long as its outer surface 12*a* is impervious to the driving fluid. In either event, however, that follower is a slidable solid, or pressure-impervious part, of the side end wall 17.

The piston 3 is dimensionally constructed and arranged to have a surface area substantially equal to a conventional double acting hydraulic fluid piston 21 of the type shown in the prior art cylinder of FIG. 1. Piston 3 is also shown in various other embodiment both with and without any annular recess 10. In such embodiments, as was also true for the case of prior art piston 21, a double-acting piston is provided. In this invention however, the piston has a cylindrical follower that is slidably mounted in a side wall 17. Acting both as a slidable part of an end wall and a piston follower, the inventive feature achieves a savings in driving fluid and its attendant costs.

Figure 4:
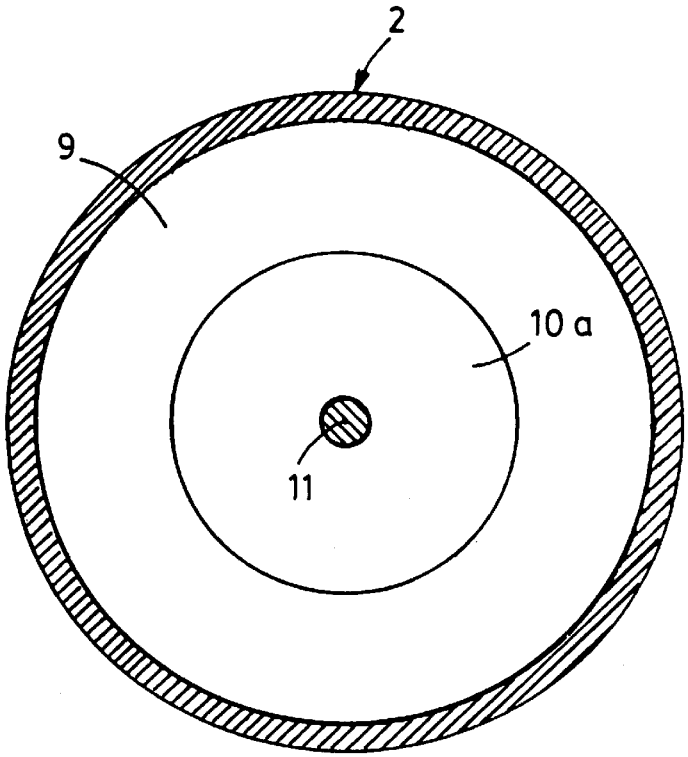
FIG. 4 is a view taken along line 4—4 of FIG. 3.
Figure 5:
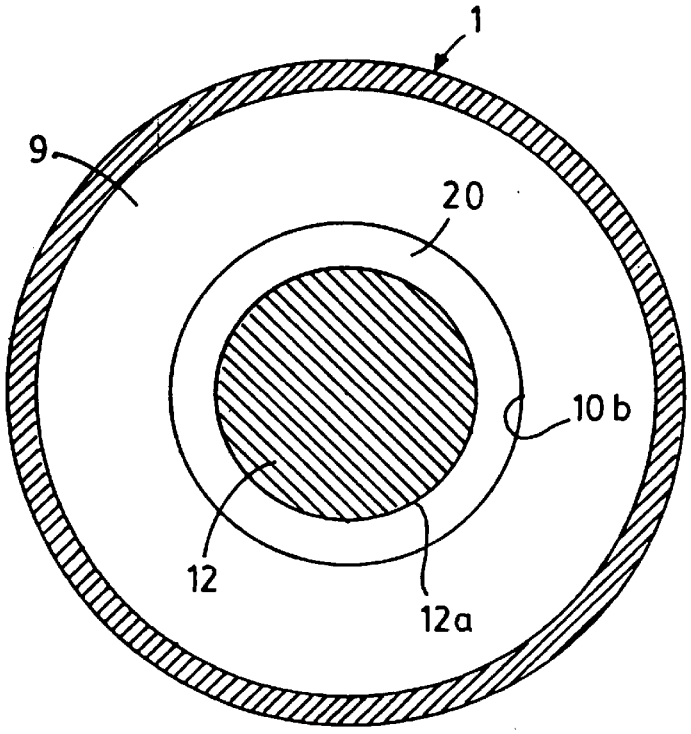
FIG. 5 is a view taken along line 5—5 of FIG. 3.
Figure 14:
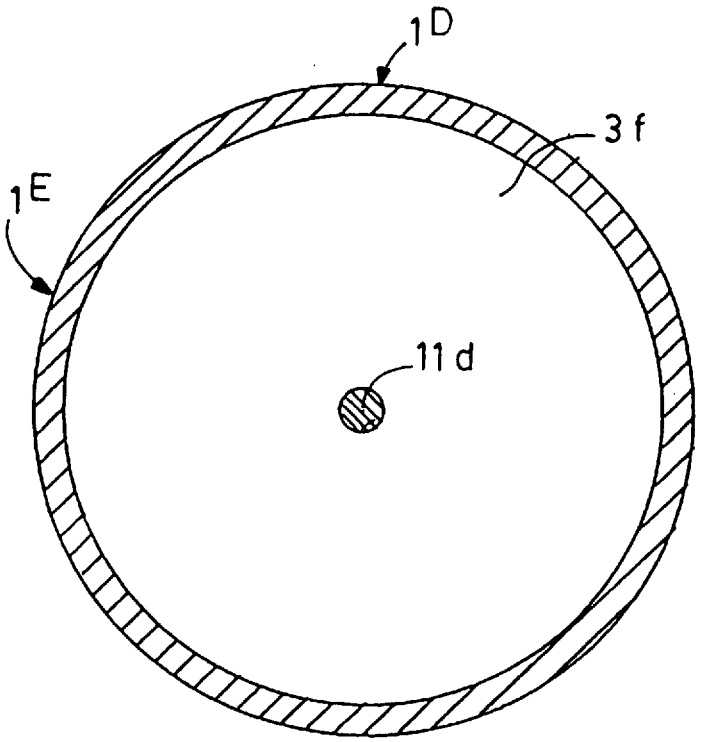
FIG. 14 is a section taken along the indicated line 14—14 of FIG. 12, and FIG. 13.

Comparison of FIGS. 4, 5 and 14 show the closeness of piston surface areas for the novel structure of this invention in comparison to the prior art piston face area for the piston 21 of FIG. 1. While the surface areas of the faces of pistons 3 and 21 are substantially equal, the volumes of the respective chambers 18, 19 for the invention and the chamber 26 of the prior art of FIG. 1 are clearly not equal. The volume of chambers 18 and 19 are less than the volume of chamber 26 by an amount equal to the volume of the piston follower 12 occupied during its stroke.

Figure 12:
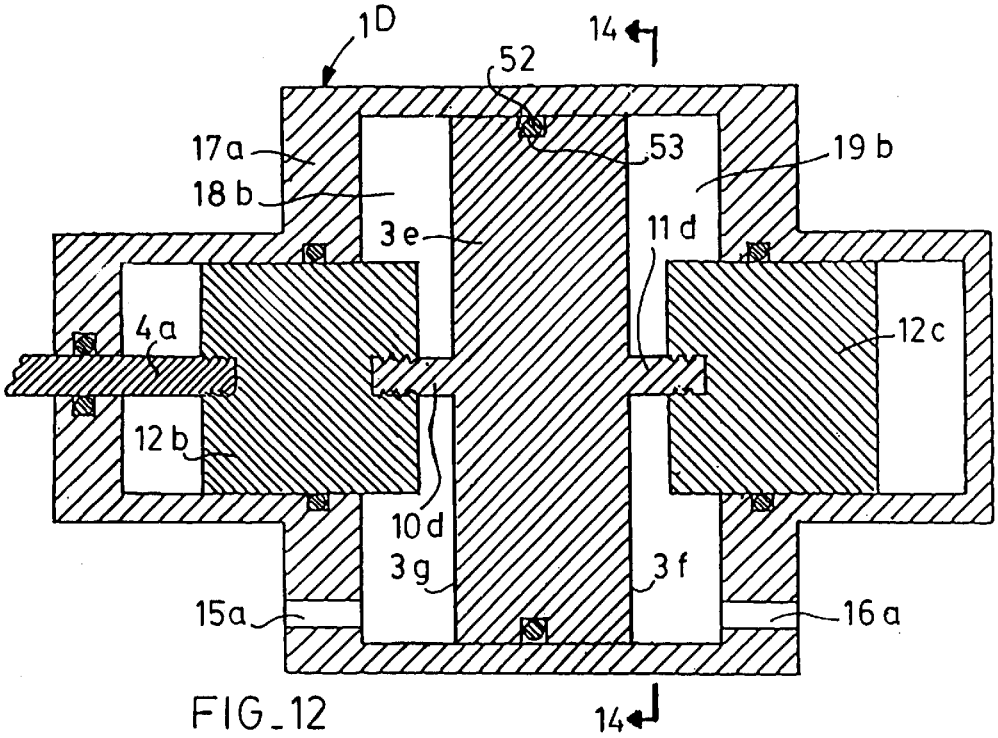
FIG. 12 is a sectional side elevation view of the novel cylinder similar to the one shown in FIG. 6 of the present invention, but without any annular channel in the piston face.
Figure 13:
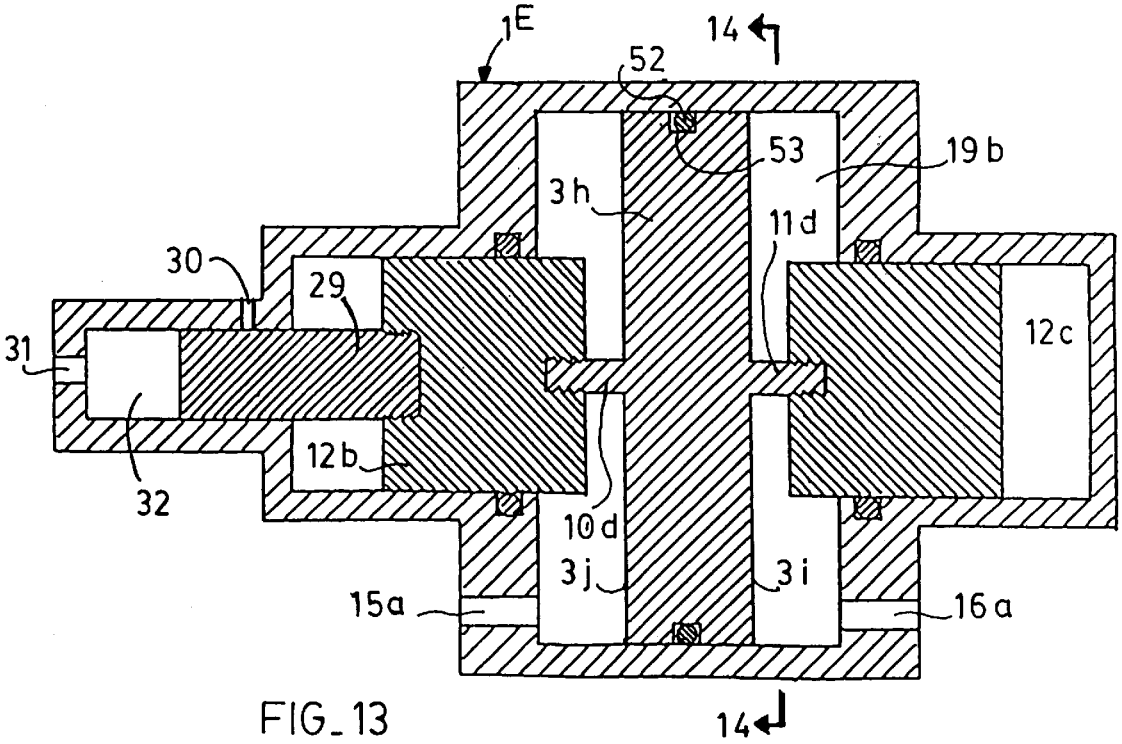
FIG. 13 is sectional side elevation view of a booster similar to the one shown in FIG. 7 of the present invention, and also depicted without an annular channel.

FIG. 14 is a section which shows the fluid pressure surface areas of pistons 3*f* and 3*i* of hydraulic cylinder 1D and booster 1E shown in FIGS. 12 and 13. Both pistons are assumed to have the same dimensions, and in both FIGS. 12 and 13, an O-ring 51 is mounted in a recess 52 provided respectively in piston 3*f* and piston 3*i*.

By far the most convenient and desirable shape for my cylinder invention is cylindrical as shown in FIGS. 3, 4 and 14. For a typical non-limiting dimensional example, please assume in FIG. 3 the full stroke distance for piston/follower may be on the order of one inch, the diameter of the piston 3 may be about three and one-half inches and the diameter of the end-wall-follower 12*b*/12*c* may be about one and one-half inches, and the diameter of the stem 11 is 0.25 inches.

The assumed area against which hydraulic oil will push, for sake of a definite example, is total surface area of piston 3 minus the stem connection area. Hence (3.5" times 3.5" times 0.7854) minus ( 0.25" times 0.25" times 0.7854) which equals 9.57206 square inches. And the volume of the assumed oil required for one complete advancing stroke will therefor be: 1" ( 3.5" times 3.5" times 0.7854) minus 1" (1.5"×1.5"×0.7854) or 7.854 cubic inches. (Also it should be noted that the volume of assumed oil occupying annular channel 10 is neglected in this calculation since it will remain constant during both advancing and retracting position and it is not absolutely necessary for the invention as shown by the drawings and claims hereof.)

Assuming that the surface of the prior art piston area is equal to the same 9.57206 square inches of the assumed example of present invention and has the same stroke length of one inch, the oil required for one complete advancing stoke will be 9.57206×1" or 9.57206 cubic inches Clearly the volume of driving oil is significantly less in accordance with the operational principles of my invention. Such a reduction in volume represents a great deal of savings in time, cost and energy efficiency.

Figure 6:
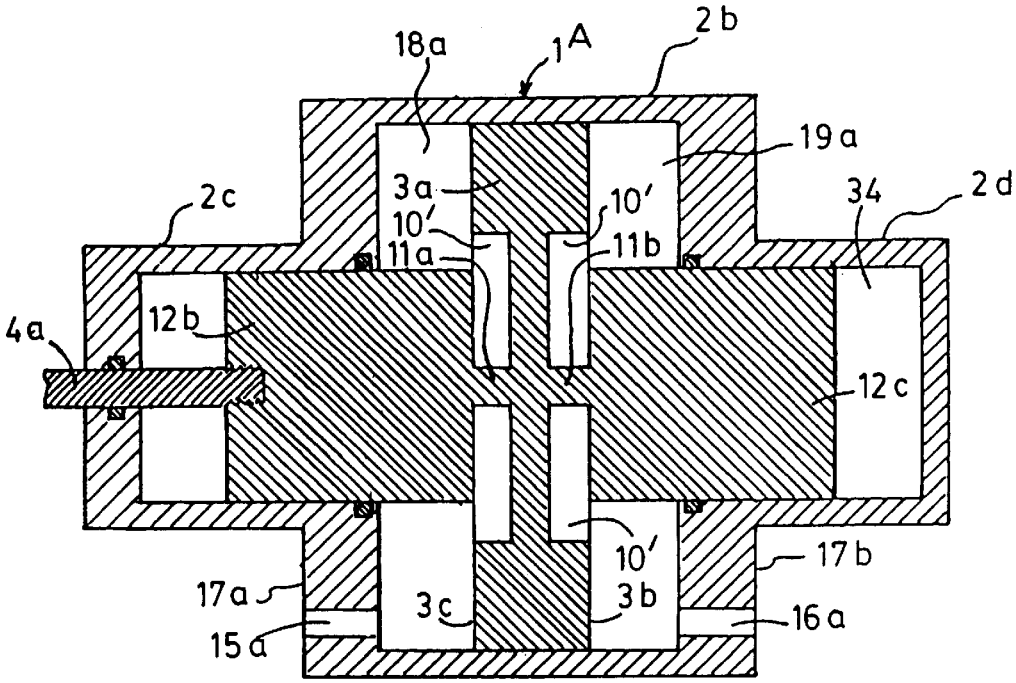
FIG. 6 is a sectional side elevation view of a working cylinder having a double-sided follower which incorporates the principles of the present invention.

The basic feature of the low volume hydraulic fluid concept for extending the hydraulic cylinder to the extended position can also be employed for retracting the hydraulic cylinder as shown, for example, in FIG. 6 in a mid-retracting position. In that Figure a hydraulic cylinder 1A comprises a cylindrical housing 2B having a piston 3*a* slidably mounted therein. Opposite face areas 3*b*, 3*c* of the piston 3*a* are provided with annular channels 10' surrounding oppositely extending stem parts 11*a*, 11*b* integral with both sides of the piston 3*a*. In FIG. 6 each piston face has its own follower that is numbered as 12*b* and 12*c* respectively for faces 3*c* and 3*b*. Again in this embodiment these solid followers form a slidable part of the side end walls 17*a* and 17*b*.

As described earlier, a piston rod 4*a* is connected to the second follower 12*b*, and hydraulic fluid inlet and outlet ports 15*a* and 16*a* are provided in the side end walls 17*a* and 17*b* of the cylindrical housing 2*b*. These ports communicate, respectively, with the annular chambers 18*a* and 19*a* of FIGS. 6 and 7.

Figure 7:
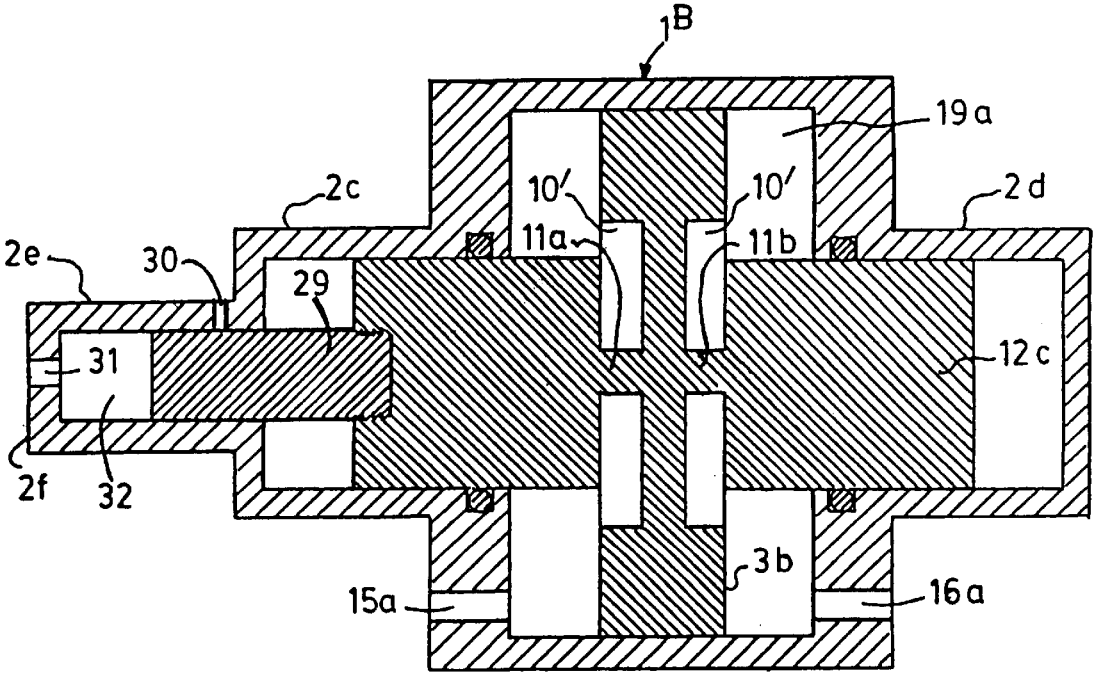
FIG. 7 is a sectional side elevation view of a booster based upon the principles of the present invention.

The hydraulic cylinder 1A of FIG. 6 can be modified, as shown in FIG. 7, to provide a booster 1B wherein the housing extension 2*c* is provided with a further extension 2*e* of smaller diameter than housing extension 2*c*. In lieu of the piston rod 4*a*, shown in FIG. 6, a plunger or ram 29 may be connected to the slidable solid part 12*b* of end wall 17*a*.

An intake port 30 is provided in the wall of housing extension 2*e* and communicates with a source of low pressure hydraulic fluid. And, an outlet port 31 is provided in the end wall 2*f* of the housing extension 2*e* communicating with the intake port of a working hydraulic cylinder of the type shown in FIG. 6. In FIG. 7, a pressure chamber 32 is provided within the housing extension 2*e*, between the end wall 2*f*, and end of the plunger 29 and is adapted to be sequentially filled with hydraulic fluid during the reciprocation of the piston 3*b*.

Figure 8:
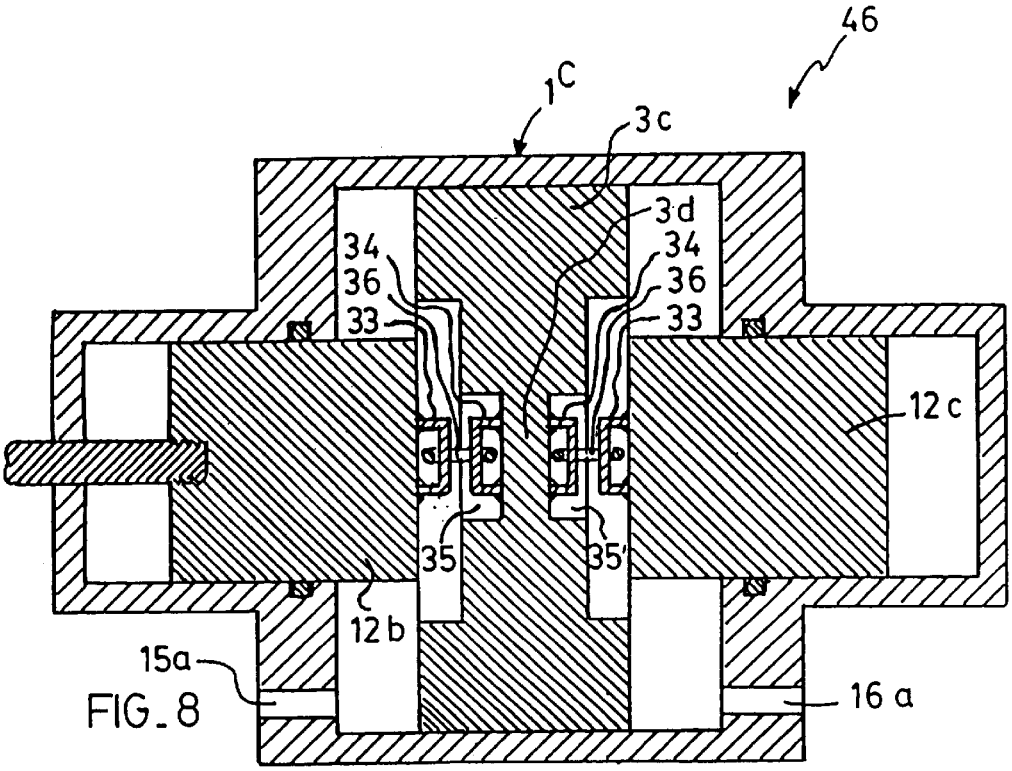
FIG. 8 is a sectional side elevation view of a piston and follower combination showing an alternate connection embodiment of the cylinder shown in FIGS. 2 or 6.

While the pistons 3*a* and 3*b*, shown in FIGS. 6 and 7, are connected to their respective second followers 12*b* and 12*c* by stems 11*a* and 11*b*, FIG. 8 shows a modified hydraulic cylinder 1C. In such a cylinder the piston 3*c* is connected to the oppositely extending slidable solid part 12 of the end wall 12*b*, 12*c* by a connection provided by a first pair of oppositely extending channel members 33 integral with the inner faces of the followers 12*b* and 12*c* Additionally, a second pair of correspondingly facing channel members 34 are positioned within respective recesses 35 provided in the oppositely extending faces of the piston 3*c*. The channels 34 are integral with a web part 3*d* formed on the piston 3*c*, and a pair of chain links 36 extend between and through the channel members 34 and 35.

Figure 9:
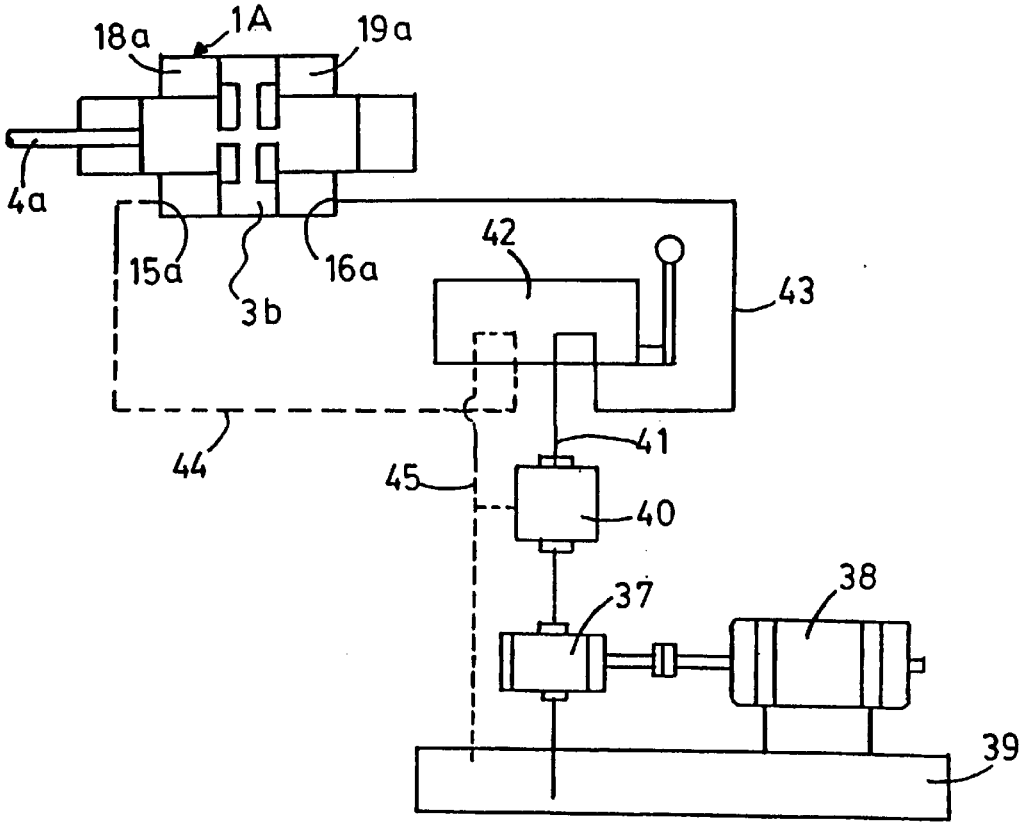
FIG. 9 is a schematic of a hydraulic circuit employing a working cylinder of the invention as depicted in FIG. 6.

A basic hydraulic circuit for actuating the hydraulic cylinder 1A is illustrated in FIG. 9, wherein a pump 37 operated by a prime mover 38 which mover delivers hydraulic fluid from a reservoir 39 through a pressure relief valve 40 to delivery line 41 and through a four-way directional control valve 42. From the directional control valve 42, the hydraulic fluid flows through supply line 43 to the inlet port 16*a* of hydraulic cylinder 1A filling the chamber 19*a*, thereby causing the piston 3*b* to move the piston rod 4*a* to the extended position. During the sliding of the piston 3*b* and associated piston rod 4*a* to the extended position, hydraulic fluid in chamber 18*a* is exhausted through port 15*a*, through line 44 to the directional control valve 42, and through return line 45 to a reservoir 39.

To return the piston 3*b* and associated rod 4*a* to the retracted position, the directional control valve 42 is shifted so that the exhaust and return line 44 become supply line through which the hydraulic fluid flows from the reservoir 39 to port 15*a* in the hydraulic cylinder 1A to thereby fill chamber 18*a*, while hydraulic fluid is being exhausted from chamber 19*a* back to the reservoir 39.

Figure 10:
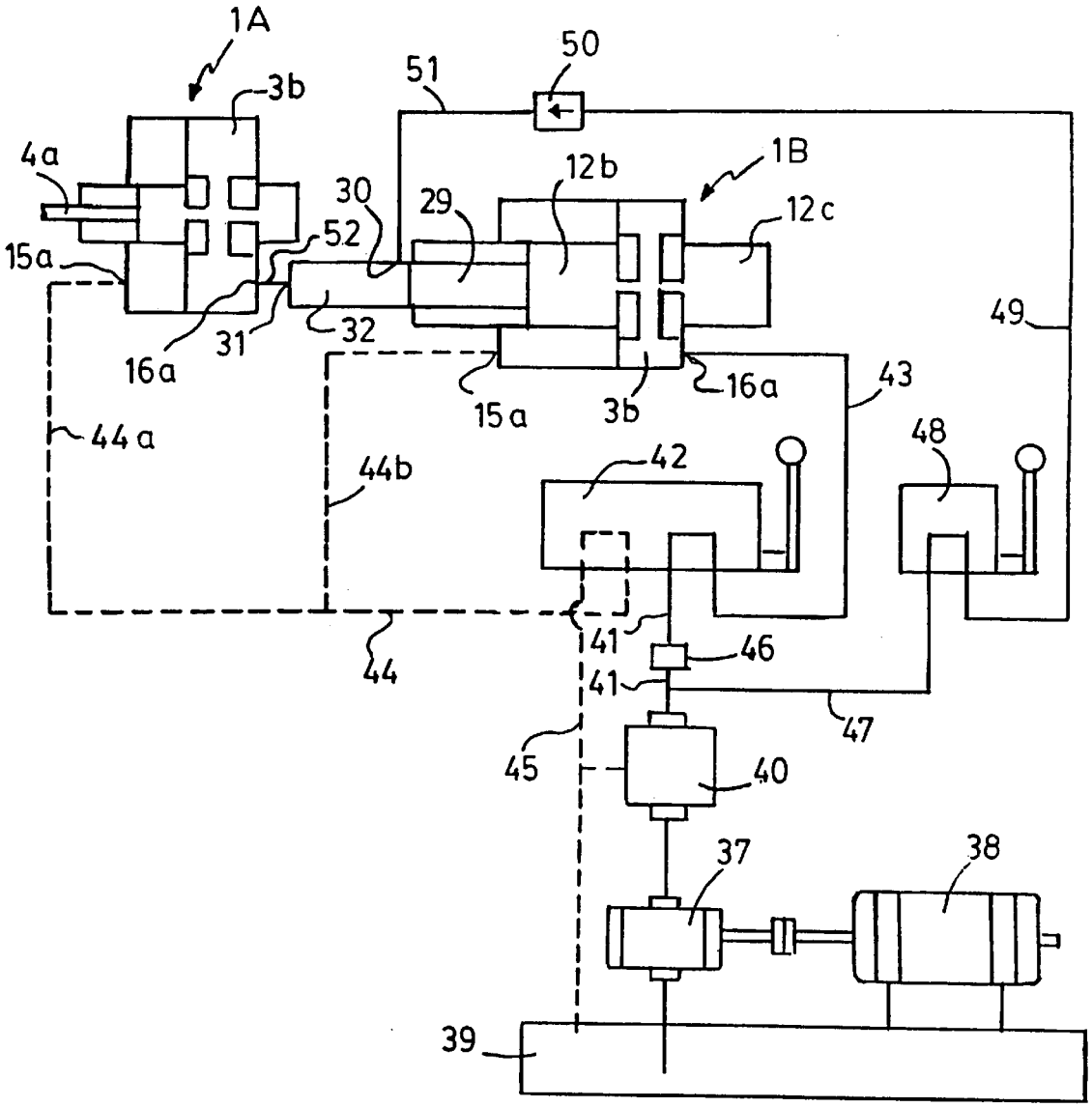
FIG. 10 is a schematic of a hydraulic circuit employing an inventive booster and a working hydraulic cylinder of the present invention, the booster and hydraulic cylinder being in the retracted position.

FIG. 10 illustrates the use of the hydraulic cylinder 1A and booster 1B of the present invention mounted in a low pressure hydraulic circuit which includes the basic circuit illustrated in FIG. 9, but with the addition of a gate valve 46 in the line 41 between the pressure relief valve 40 and the four-way directional control valve 42. A two-way directional control valve 48 is mounted in a branch line 47 communicating with the line 41 and another line 49 having a check valve 50 mounted therein and communicating with another line 51 connected to the booster port 30 which communicates with a booster chamber 32.

Port 31 of the booster 1B is connected to the port 16*a* of the hydraulic cylinder 1A by a line 52, and branch lines 44*a* and 44*b* are connected between the respective ports 15*a*, and return line 44. As shown in FIG. 10, the hydraulic cylinder 1A and booster 1B are in the retracted position, and valves 46 and 48 are positioned for the initial filling of the booster chamber 32; that is, gate valve 46 is closed and two-way valve 48 is positioned to allow hydraulic fluid to be pumped from the reservoir 39, through lines 47, 49, through the check valve 50, and then on to the booster chamber 32.

Figure 11:
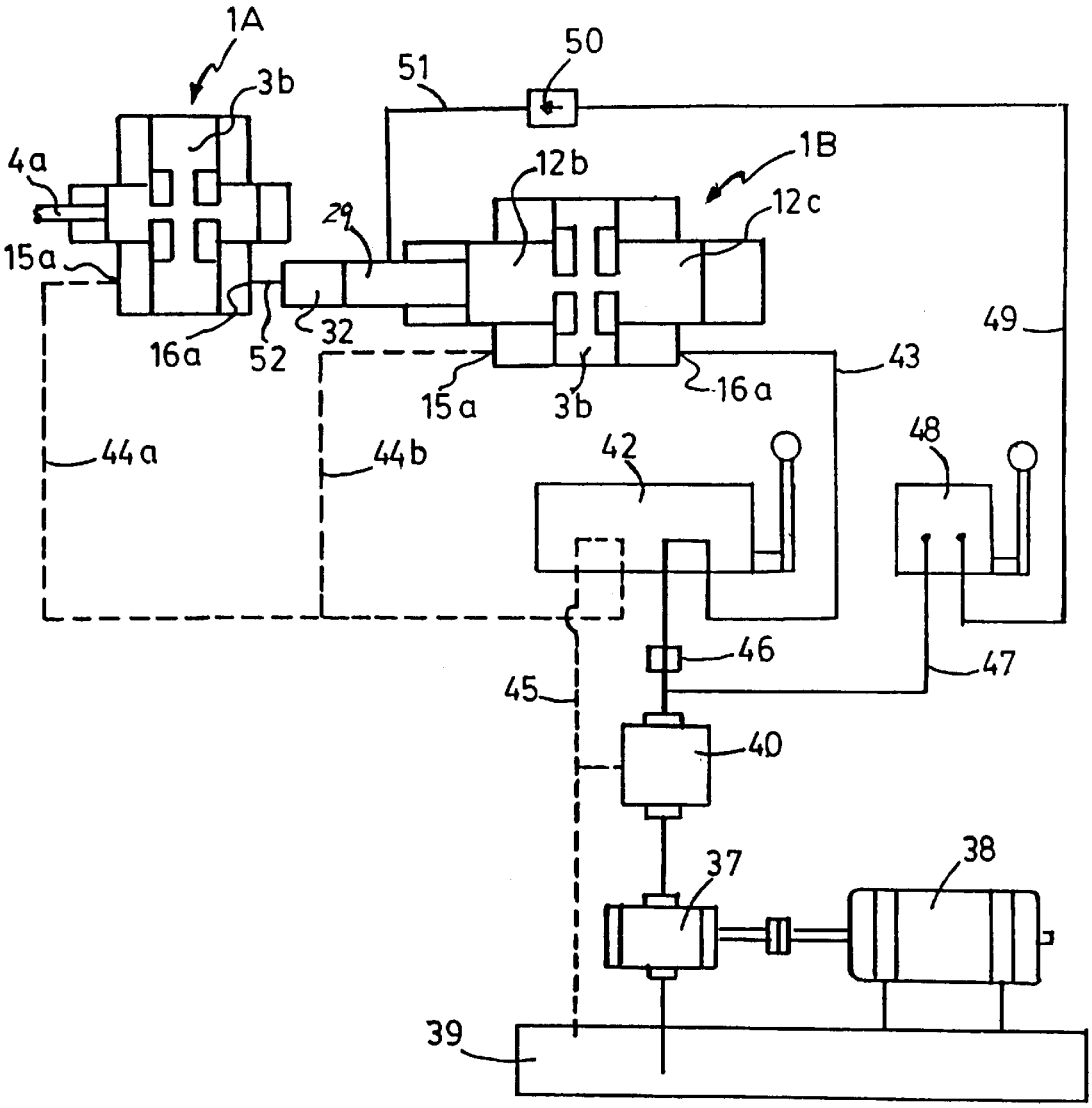
FIG. 11 is a schematic of the hydraulic circuit shown in FIG. 10 and depicting the booster and hydraulic cylinder in an extended position.

FIG. 11 illustrates the hydraulic circuit of FIG. 10 wherein the hydraulic cylinder 1A and booster 1B are being actuated to the extended position after the filling of the pressure chamber 32 has been completed in the booster 1B, as described before in connection with FIG. 10. To actuate the hydraulic cylinder 1A and booster 1B, the two-way directional control valve 48 is shifted to the closed position, and gate valve 46 is open allowing the hydraulic fluid to flow from the reservoir 39 to the four-way directional valve 42 which is positioned to allow low pressure hydraulic fluid to enter port 16*a* in the booster 1B, acting on piston 3*b*, to cause the plunger 29 to force high pressure hydraulic fluid into the hydraulic cylinder port 16*a* and thereby act against the piston 3*b* to move the piston rod to the extended position.

As shown in FIG. 12, a hydraulic cylinder 1D (similar to hydraulic cylinder type 1A shown in FIG. 6) is provided. It should be noted, however, that the piston 3*e* in FIG. 12 has flat faces 3*f* and 3*g* and such faces do not have any annular channels. Still both hydraulic cylinders operate in the same manner based on the same concept, where oil at certain pressure enters through port 16*a* and presses against the face 3*f* of piston 3*e* toward advancing position where the first slidable solid part 12*c* of end wall 17*c* follows piston 3*e* and occupies its volume inside chamber 19*b*.

Since both piston 3*e* and the first slidable solid part of end wall 12*c* are connected by the stem 11*d*, then both move together for the reasons described earlier herein. In FIG. 13, a booster 1E—similar to booster 1B shown in FIG. 7—is provided. Except in FIG. 13, please note that the piston 3*h* has flat faces 3*i* and 3*j* and booster 1E still operates in the same manner as booster 1B and is based on the same inventive concept described and claimed herein.

Also both FIGS. 12 and 13 show that the hydraulic cylinder and the booster of the present invention could be modified without annular channels surrounding their stems without changing the fluid pressure outcome—assuming they have the same dimensions for a comparison. Also, in the modified FIGS. 12 and 13, the fluid is reduced during their strokes by the occupied volumes of their first slidable solid follower parts 12*b* and 12*c* of the housing end walls as shown.

FIG. 14 is a section which shows the surface area 3*f* and 3*i* of piston 3*e* and 3*h* respectively of hydraulic cylinder 1D and booster 1E, where fluid pressure applied on, also both assumed to have the same dimensions, and in both FIGS. 12 and 13, an O-ring 51 is mounted in a recess 52 provided respectively in piston 3*f* and piston 3*i*.

Figure 15:
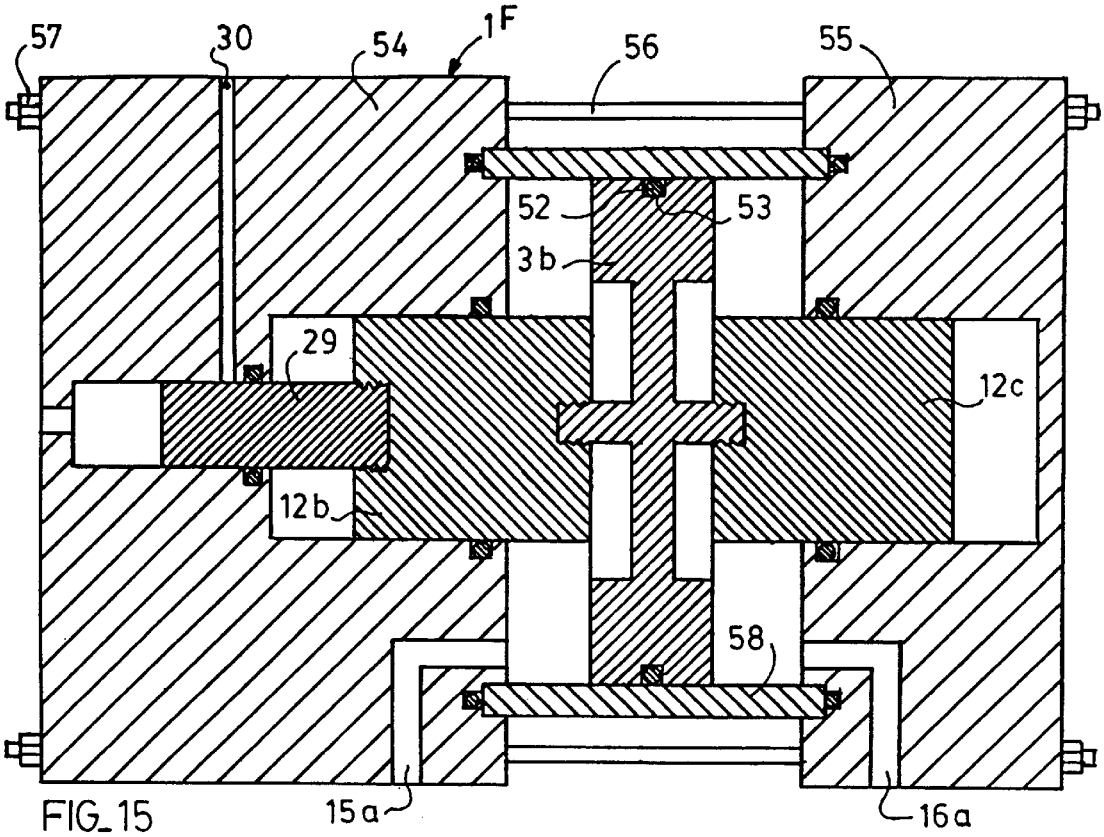
FIG. 15 is the same section of the booster of the present invention of the type shown in FIG. 7, but with a cylindrical housing detailed to include head, cap, tie rods, and bore.

FIG. 15 shows a booster 1*f* similar to booster 1*b* of FIG. 7, but with its cylindrical housing detailed to include its side end walls as head 54, cap 55, and tie rods generally indicated as 56, and tie rod nuts generally indicated as 57. Also shown in some detail in FIG. 15 is a booster bore 58 with the booster ram 29 of the present invention in a mid position.

Figure 16:
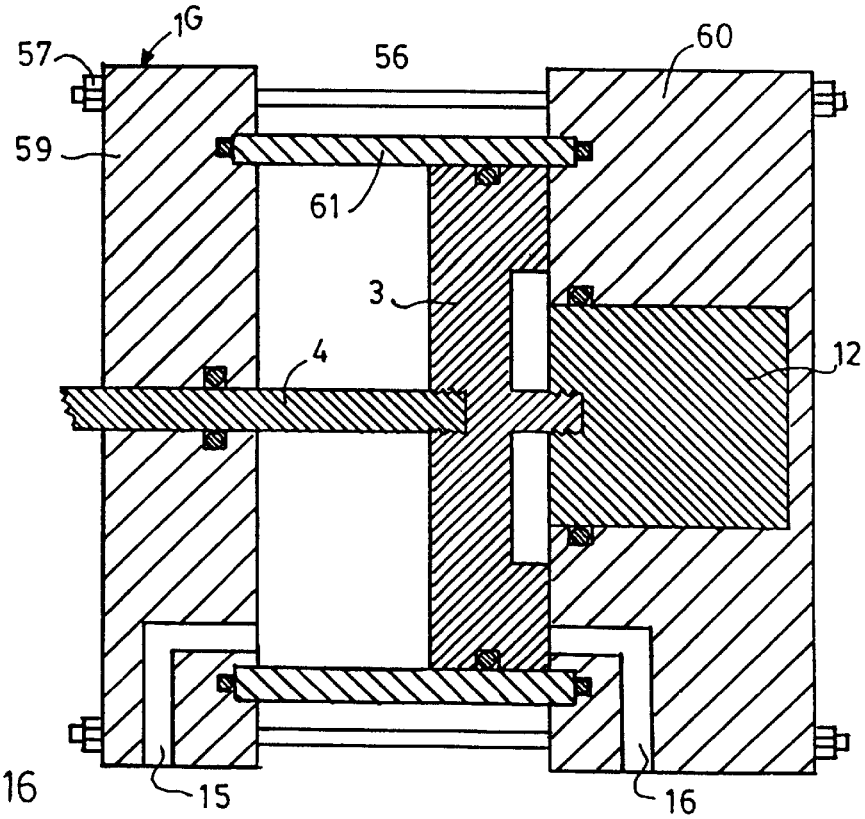
FIG. 16 is the same section of the hydraulic cylinder of the present invention shown in FIG. 2, but with its cylindrical housing detailed to include head, cap, tie rods, and bore.

FIG. 16 shows a hydraulic cylinder 1*g* similar to hydraulic cylinder type 1 shown in FIG. 2, but with its cylindrical housing 2 detailed to include its side end walls 8 and 17 as head 59 and cap 60 respectively, also detailed to include the bore 61 of the hydraulic cylinder of the present invention also detailed to include tie rod 56, and tie rod nuts 57.

Figure 17:
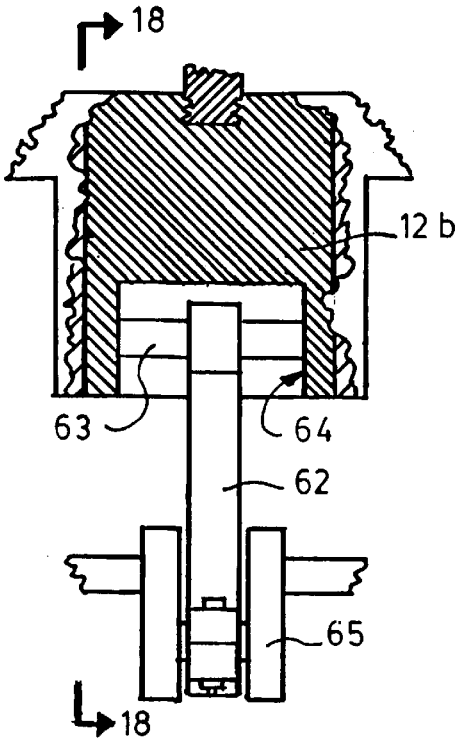
FIG. 17 is a partial section which shows the linear piston rod of the present invention replaced by a connecting rod, piston pin and crankshaft for applying circular push or thrust.

FIG. 17 is a partial section of the second slidable solid part of end wall 12*b* of the hydraulic cylinder of the present invention modified to transmit a linear stroke to a rotary turn on a crankshaft 65. A conventional connecting rod 62 is located between crankshaft 65 and a piston pin 63 situated inside a tubular or cylindrical extension 64 of follower 12*b*. Rod 62 is journalled at the end of the piston follower 12*b*. The piston pin 63 forms a pivot connecting one end of the connecting rod 62 to the second slidable solid part 12*b* of end wall and its tubular extension 64.

Figure 18:
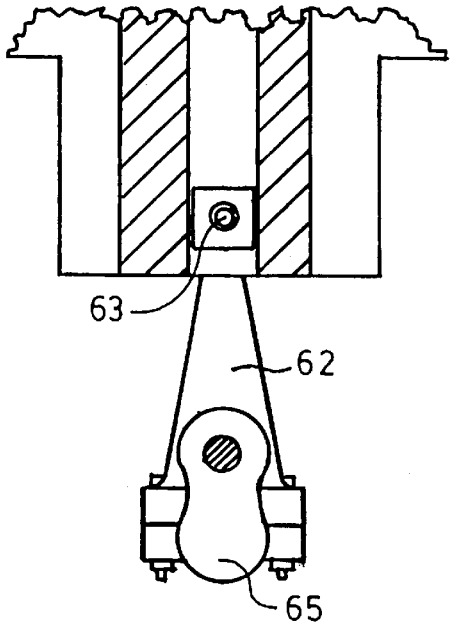
FIG. 18 is section taken along the indicated line 18—18 of FIG. 17.
Figure 19:
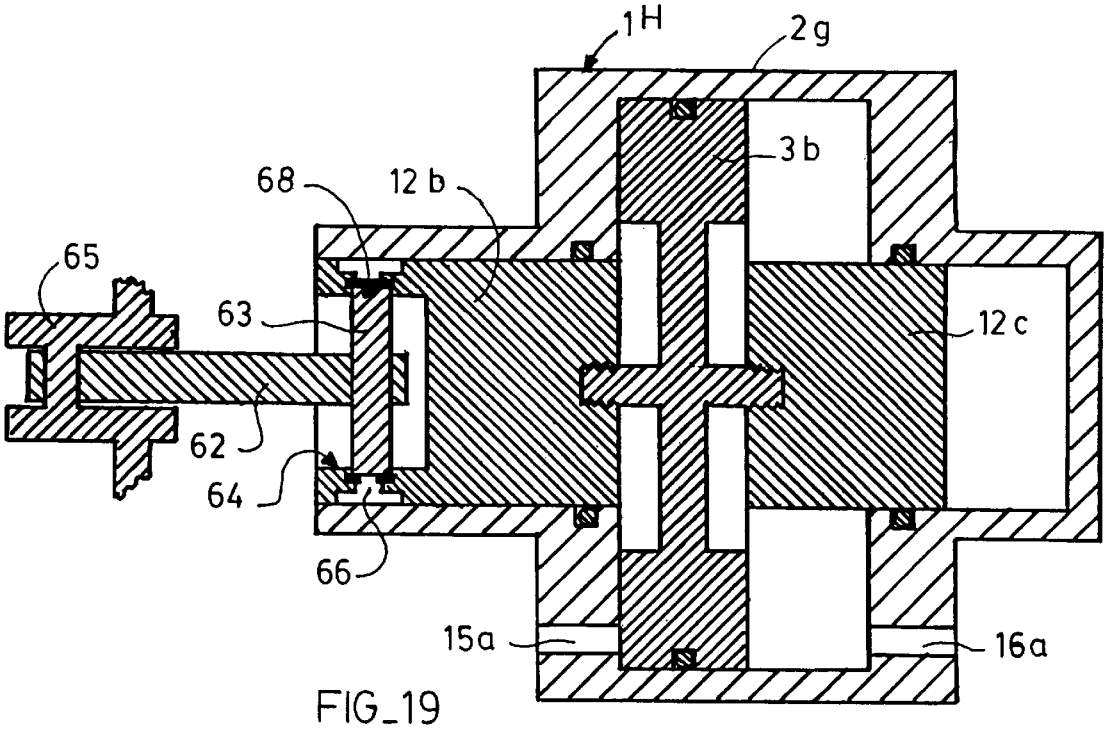
FIG. 19 is a sectional side elevation view of a hydraulic cylinder of the present invention shown connected to a crankshaft.

As shown in FIGS. 18 and 19 the piston pin 63 is secured by two holes generally indicated as 66 recessed into the wall 67 of the cylindrical extension 64. Retaining rings generally indicated as 68 are shown fitted into the recesses 66 at the ends of the piston pin 63 so as to prevent the pin working to one side and rubbing against the tubular wall 64.

Figure 20:
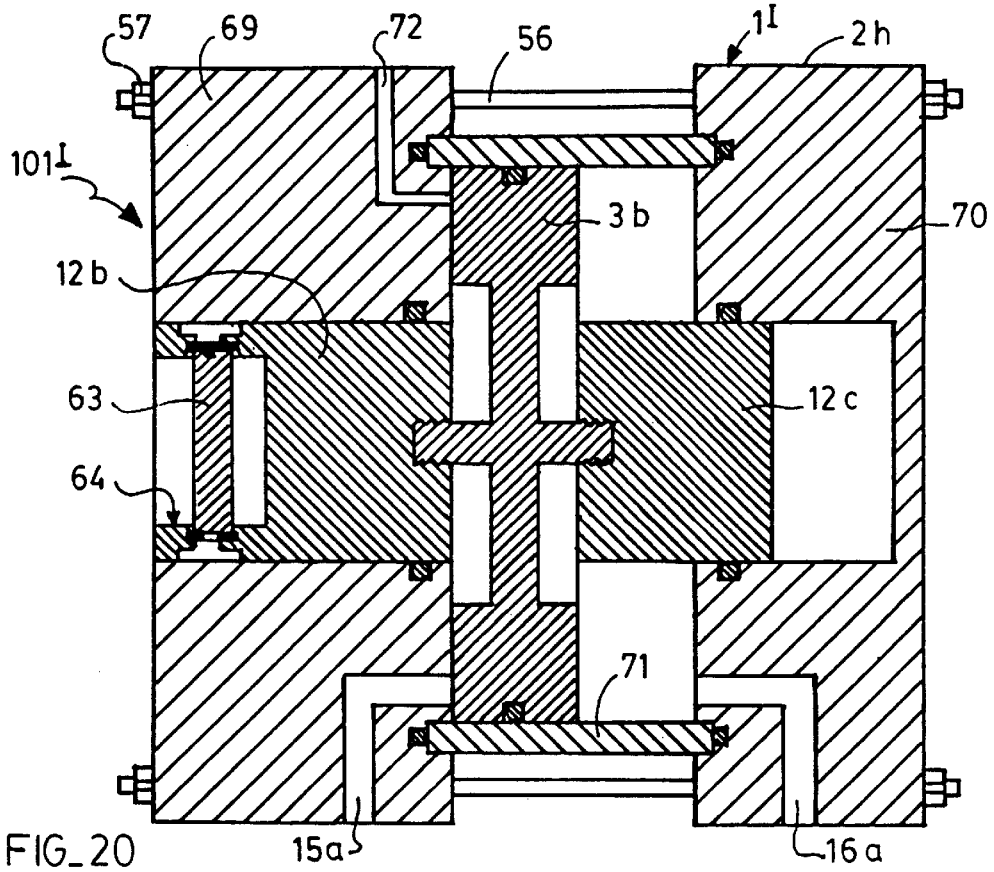
FIG. 20 is the same section of the hydraulic cylinder of the present invention shown in FIG. 19, but with its cylindrical housing detailed to include head, cap, tie rods and bore. Also an additional port to enable the hydraulic cylinder to be used in a two cycle hydraulic system, where it represents the first hydraulic cylinder shown in the upper part of the schematic illustrations of FIGS. 17, 18 and 19.

FIG. 20 shows a hydraulic cylinder 1*i* similar to hydraulic cylinder 1*h* shown in FIG. 19 of the present invention, but its cylindrical housing 2*h* is detailed to include its sides end walls as head 69 and cap 70. Also a sealed longitudinal tubing serves as bore 71 to form a sealed cylindrical pressure chamber. An additional port 72 is shown and shall be discussed later as a filling port.

The hydraulic cylinder 1*i* of FIG. 20 will be featured in a two cycle system in a schematic illustration shown and described schematically hereinafter in a series of positional snapshots presented as FIGS. 25, 26, and 27.

Figure 21:
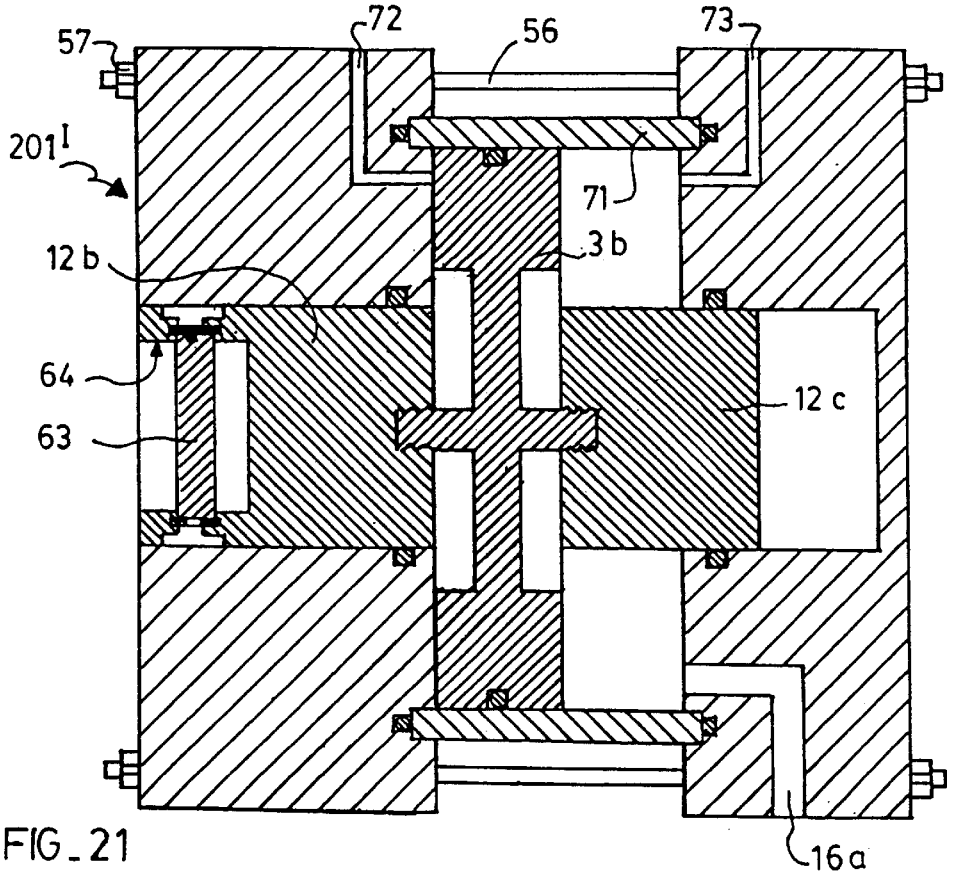
FIG. 21 is the same section shown in FIG. 20 of the present invention, but with its ports modified for use as a second hydraulic cylinder as shown in the lower part of the schematic illustrations of FIGS. 25, 26 and FIG. 27.
Figure 25:
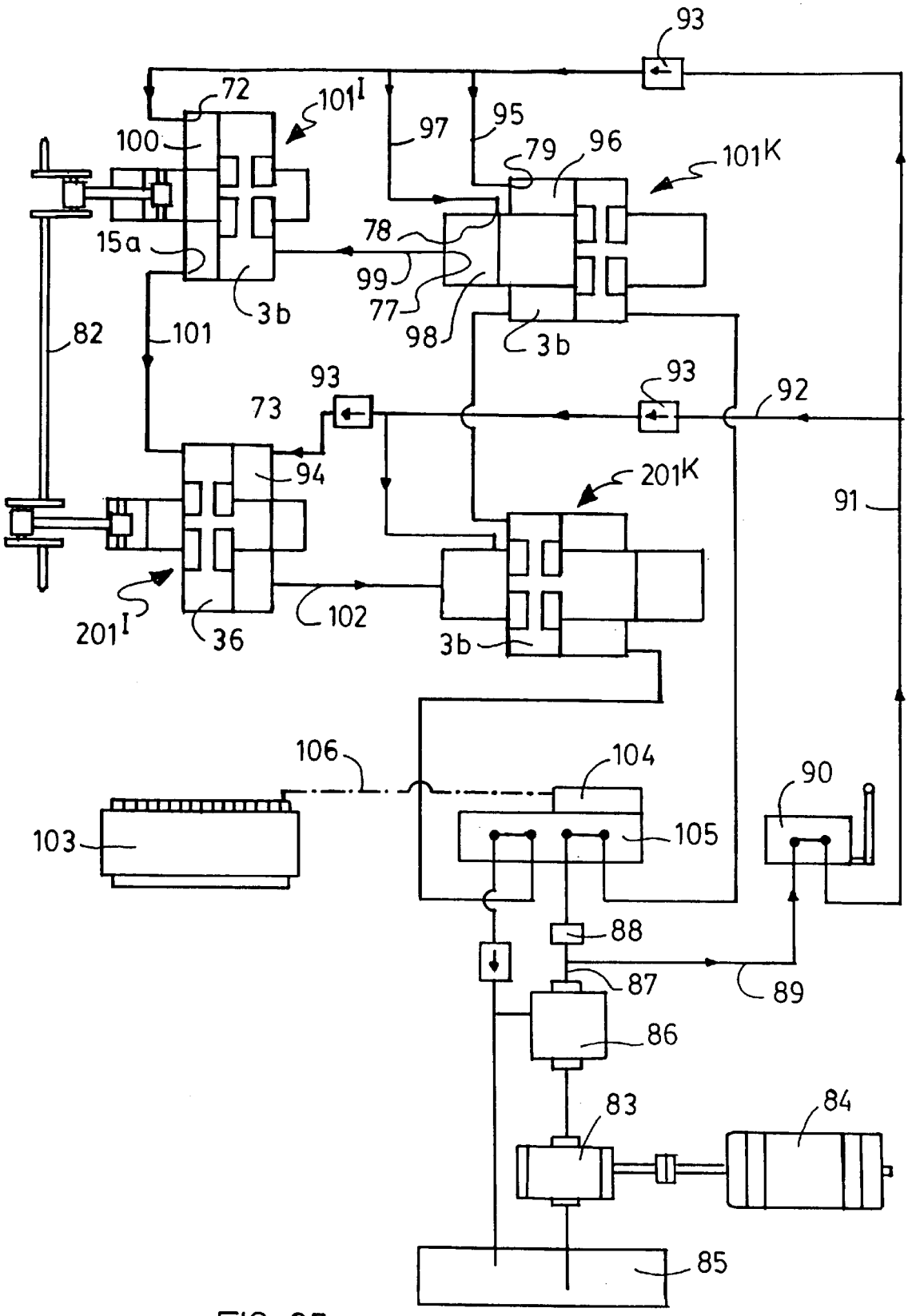
FIG. 25 is a schematic illustration of hydraulic circuitry basically similar to the hydraulic circuitry shown in FIGS. 10, and 11, but modified to accommodate the use of a timer control unit in a two cycle system, and two hydraulic cylinders and their boosters of the present invention which are shown in a filling procedure prior to operation, and also showing a crankshaft connected to the hydraulic cylinders.
Figure 26:
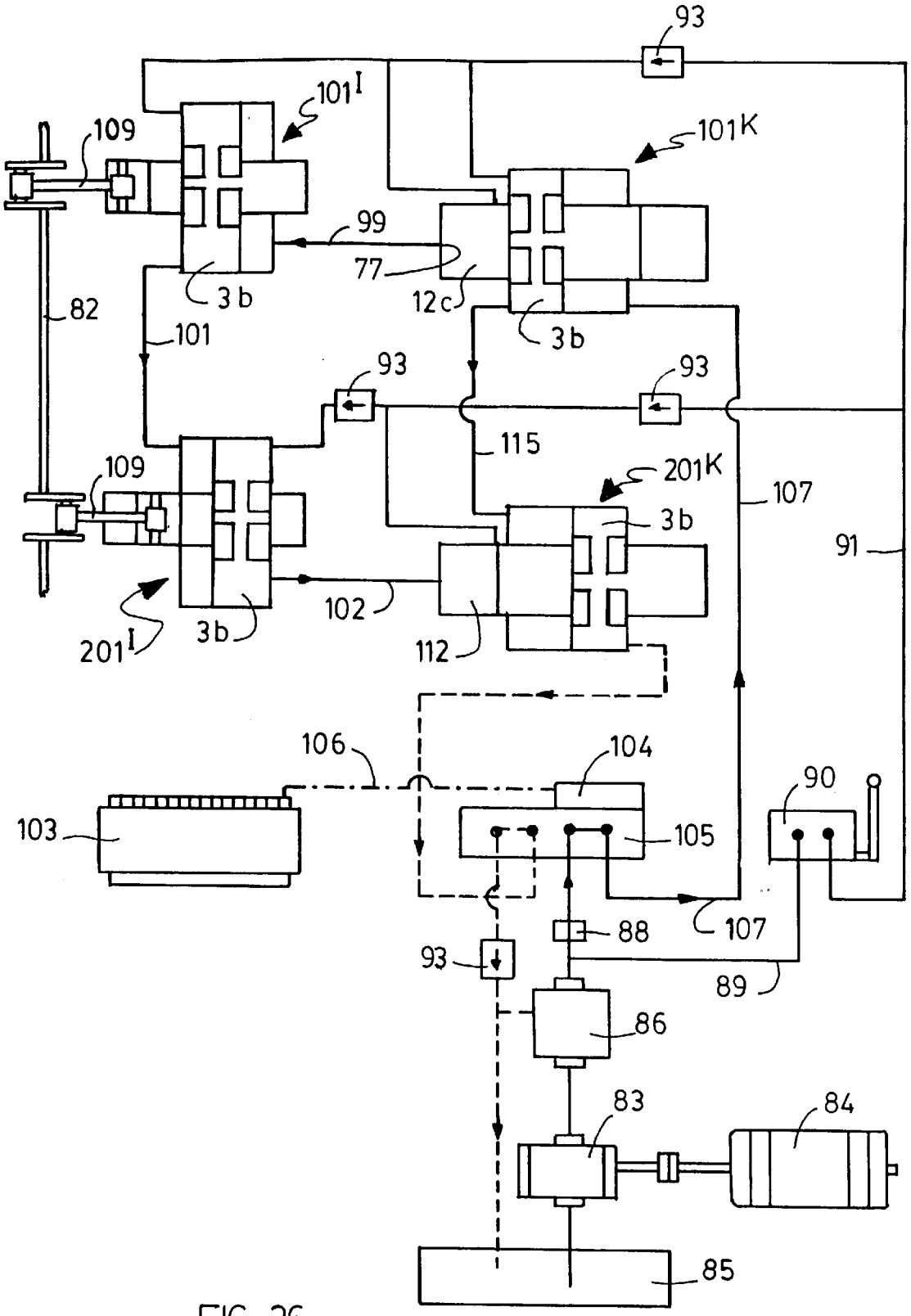
FIG. 26 is the same schematic illustration of FIG. 25, but shown when the system is in operation, with the first hydraulic cylinder and its booster of the present invention in a complete advancing position, and the second hydraulic cylinder and its booster in a complete retracting position.
Figure 27:
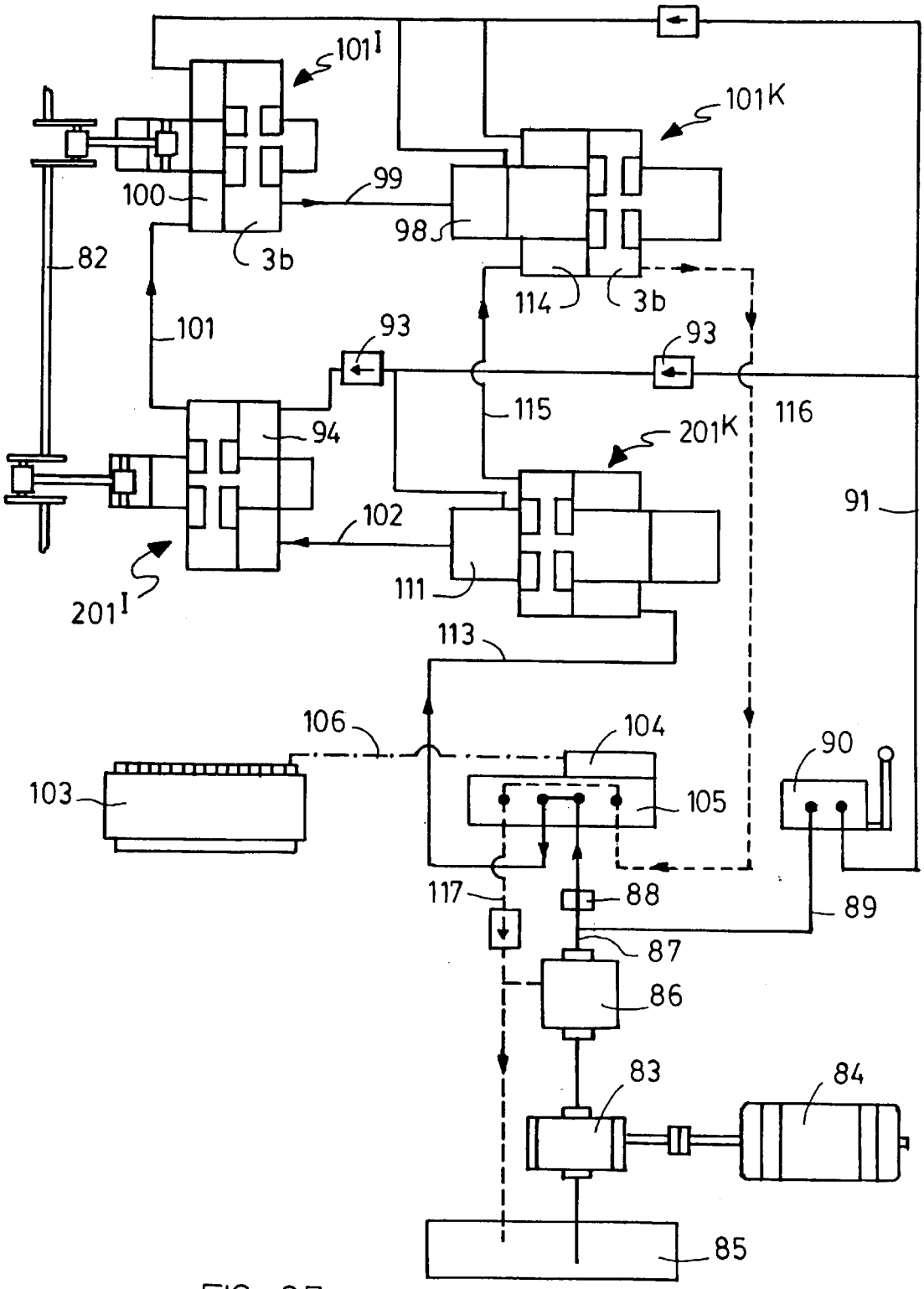
FIG. 27 is the same schematic illustration of the hydraulic circuitry shown in FIGS. 25 and 26, but with the first hydraulic cylinder and its booster in a complete retracting position, and the second hydraulic cylinder and its booster in a complete advancing position.

FIG. 21 shows a hydraulic cylinder 1*j* similar to hydraulic cylinder 1*i* of FIG. 20 but differing only in the location of the ports where another filling port 73 is located in a cap 74 and the exit port in the head 75 is omitted, since the hydraulic cylinder 1*j* will be installed in a two cycle system schematically illustrated in FIGS. 25, 26 and 27. Cylinder 1*j* will there be called the second hydraulic cylinder 201*i*. That system is described in more detail later.

Figure 22:
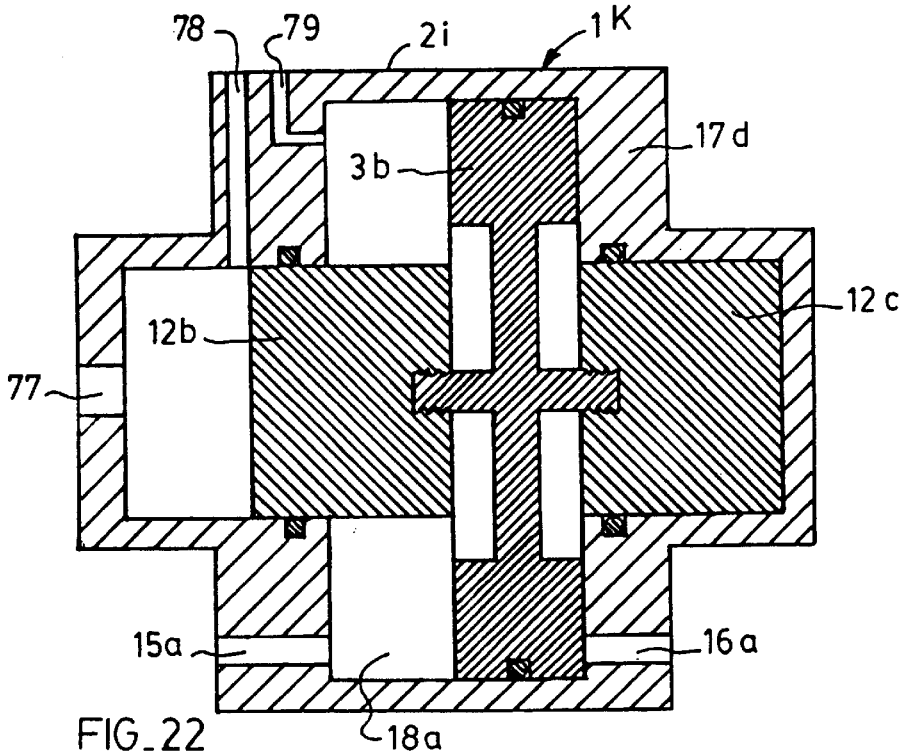
FIG. 22 is a sectional side elevation view of the booster of the present invention modified to accommodate the use of the second slidable solid part of a moveable end wall acting as a ram for the pressure chamber; and also having ports modified to accommodate its use in conjunction with the first hydraulic cylinder shown in FIG. 20 and also shown in the upper part of the schematic illustrations shown in FIGS. 25, 26 and 27.

FIG. 22 shows a booster 1*k* similar to the booster 1*b* of the present invention of FIG. 7. Booster 1*k* comprises essentially the same elements of booster 1*b* and functions as there described. Booster 1*k* is also modified by having port 78 serve as an inlet for pressure chamber 76. Also in FIG. 22 the second solid slidable part of side end wall 12*b* replaces the ram/plunger 29 of booster 1*b*, FIG. 7.

Figure 23:
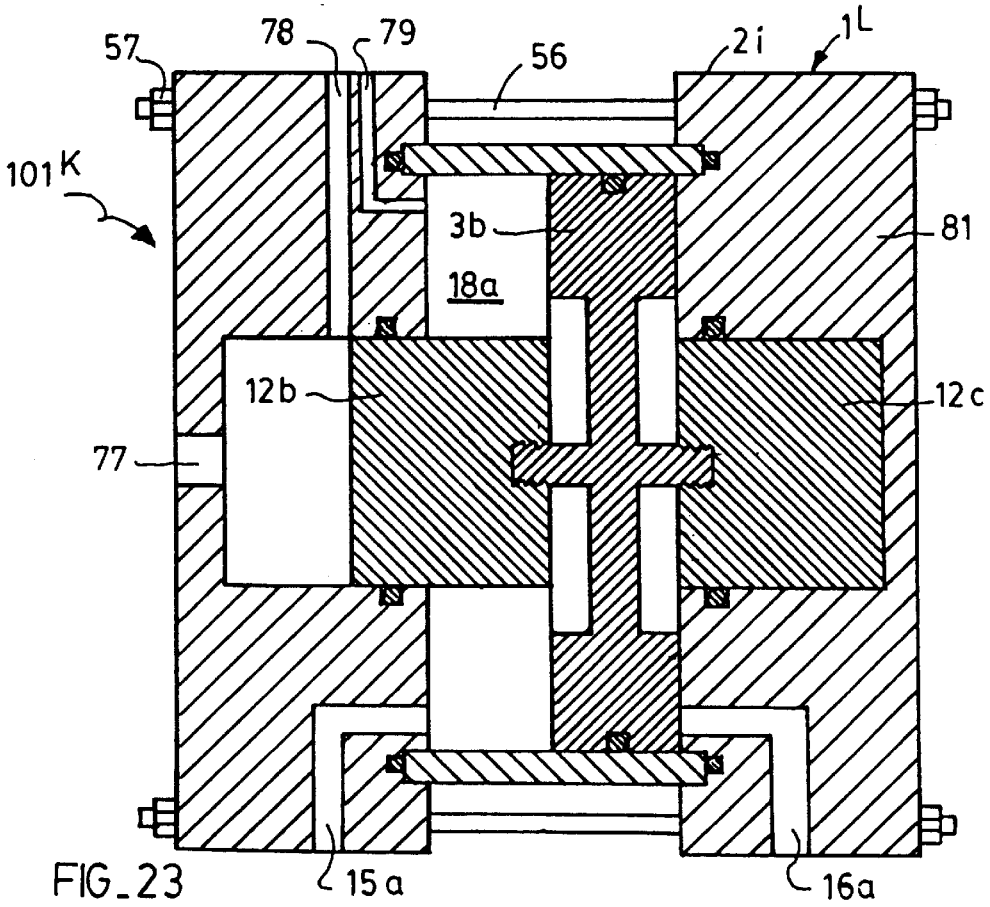
FIG. 23 is the same section shown in FIG. 22, but with its cylindrical housing detailed to include head, cap, tie rods, and bore.

Piston follower 12*b* in FIG. 22 thus acts not only to reduce chamber volume but also serves the additional function of a ram for elevating pressure inside pressure chamber 76. Inside chamber 76 an intensified fluid at high pressure is created by ram-follower 12*b*. A fluid at low pressure enters port 16*a* and pushes against piston 3*b* in an advancing position. Ram-follower 12*b* advances at the same time into pressure chamber 76 creating intensified fluid at high pressure since its diameter is smaller than the diameter of the piston 3*b*. Also FIG. 22 depicts an additional port 79 to allow the use of booster 1*k* in a two cycle system described hereinafter by FIGS. 25, 26, and 27. FIG. 23 depicts a booster 1L similar to booster 1*k*, but with side end walls 17*c* and 17*d* as head 80 and cap 81, respectively. Also the booster 1L shall be installed and called first booster 101*k* in hydraulic circuitry for the FIG. 25, 26, and 27.

Figure 24:
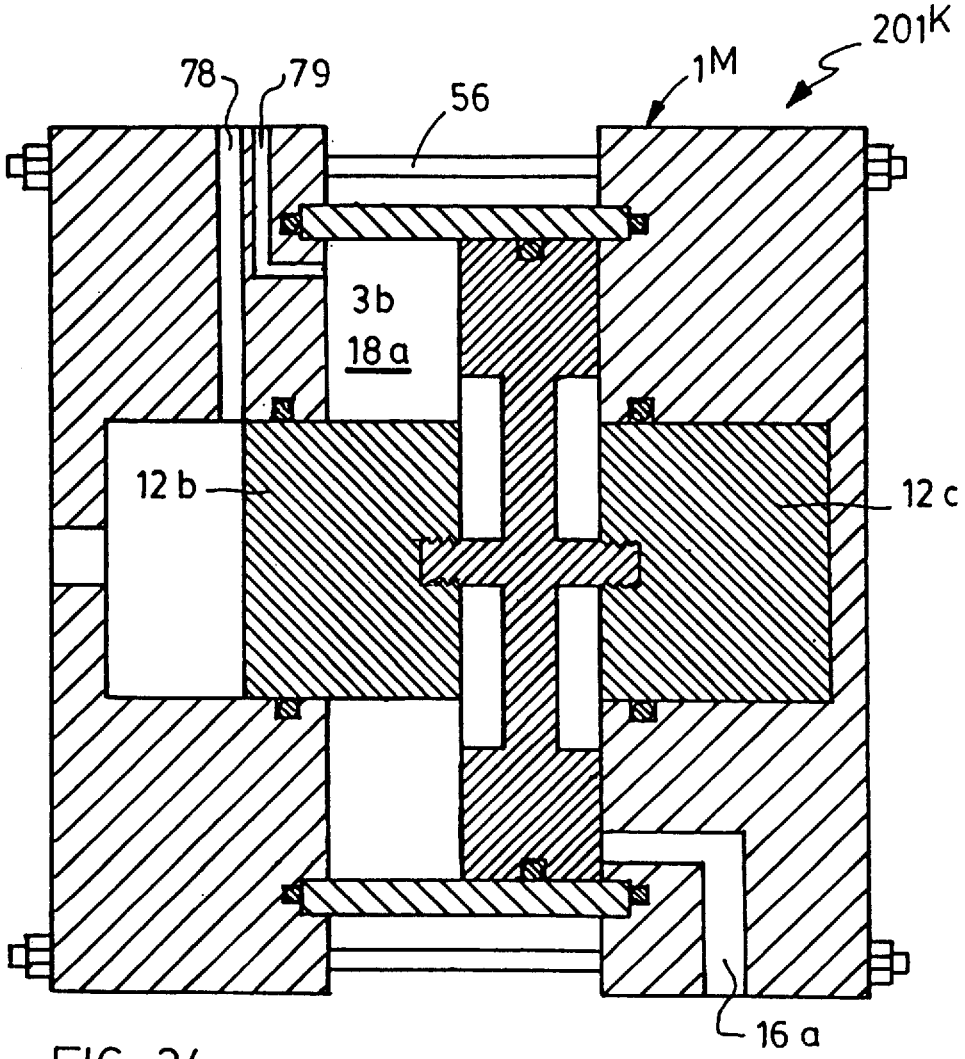
FIG. 24 is the same section shown in FIG. 23, but with its ports modified to accommodate its use in conjunction with the second hydraulic cylinder shown in the lower part of the schematic illustrations shown in FIGS. 25, 26 and FIG. 27.

FIG. 24 shows a booster 1*m* similar to booster 1*k* of FIG. 23. But, FIG. 24 differs in ports locations due to the installation of booster 1*m* in the FIGS. 25, 26 and 27 hydraulic circuitry. Booster 1*m* is there called the second booster 201*k*.

FIG. 25 shows hydraulic circuitry for a two-cycle engine. Two booster cylinder assemblies are depicted. A first hydraulic cylinder 101*i* (from the type 1*i* shown in FIG. 20) and a booster 101*k* (from the type 1L shown in FIG. 23) are employed as a first assembly. The second assembly includes a second hydraulic cylinder 201*i* (from the type 1*j* shown in FIG. 21) and a second booster 201*k* (from the type 1*m* shown in FIG. 24). Both hydraulic cylinders 101*i* and 201*i* are connected to one crankshaft 82, and each assembly is operative to impact a one-half turn to crankshaft 82.

A pump 83, operated by a prime mover 84, delivers hydraulic fluid from a reservoir 85 through a pressure relief valve 86 where it passed to line 87 to a gate valve 88. Gate valve 88 is shown closed since the schematic illustration of FIG. 25 shows an initial filling procedure prior to two-cycle operation. Hydraulic fluid flow is stopped by gate valve 88 and is thus passed to branch line 89 where arrow shows the direction of such hydraulic fluid flow.

Hydraulic fluid enters a two-way directional control valve 90 and is passed to lines 91 and 92. Located in lines 91 and 92 are one-way valves 93. The fluid passes through these one-way valves and fills the empty chambers of the cylinders and boosters. Thus, chamber 94 is filled through port 73 of the hydraulic cylinders 201*i* shown in a complete advanced position. Also at the same time, fluid from line 91 is filling the empty chambers of booster 101*k* and hydraulic cylinder 101*i*. Both are shown in a complete retracting position.

Fluid from line 91 is also passed to branch line 95 and fills the bore chamber 96 through the port 79 of booster 101*k*, while branch line 97 fills the pressure chamber 98 of booster 101*k* through its port 78. And also the fluid fills the existing line between the 101*k* and the hydraulic cylinder 101*i* through exit port 77 of pressure chamber 98 of booster 101*k*. Fluid from line 91, through port 72, fills the bore chamber 100 of hydraulic cylinder 101*i*.

Also, fluid passes from the chamber 100 of first hydraulic cylinder 101*i* during the filling procedure to line 101 through port 15*a*. Also fluid fills line 102 situated between the second hydraulic cylinder 201*i* and second booster 201*k*.

Also shown in FIG. 25 is a timer control unit 103, which may be any suitable timing control circuit such as, for example, an Epic-24, manufactured by Miller Fluid Power, located in Brensenville, Ill. Timing control 103, via an electrical lead 106, is connected to a solenoid 104 of a four-way directional control valve 105.

FIG. 26 shows the hydraulic circuitry of FIG. 25 during the operation after the filling procedure is done as described hereinbefore for FIG. 25. Control valve 90 is kept closed during the operation procedure and after the completion of the filling procedure. Fluid in FIG. 26 passes through the open gate valve 88 to the four-way directional control valve 105 to line 107 which delivers fluid at low pressure to the first booster 101*k*, which fluid pushes piston 3*b* and slidable part of end-wall-follower 12*c* (in the manner earlier described).

An intensified fluid at higher pressure is created inside pressure chamber 98 and enters the chamber 108 of 101*i*, thus impacting a one-half turn to the crankshaft 82.

The volume of the pressure chamber 98 of booster 101*k* is equal to the volume of the chamber 108 of cylinder 101*i* so when the intensified fluid is exhausted totally from pressure chamber 98 of booster 101*k* it will fill totally the chamber 108 of first hydraulic cylinder 101*i*. At the same time fluid from chamber 100 passes into line 101 to chamber 110 of the cylinder 201*i*. The volumes of hydraulic fluid are again equal so when the fluid which exists in chamber 100 is totally exhausted into chamber 110, piston 3*b* of hydraulic cylinder 201*i* moves toward a complete retracting stroke.

When the first one-half turn to the crankshaft 82 is done by the first hydraulic cylinder 101*i* and its booster 101*k*, the timer control unit 103—which controls the four-way directional control valve by its solenoid 104—moves the four-way directional control valve 105 to its second position shown in FIG. 27. Cylinder 201*i* and booster 201*k* then impact the other one-halve turn to the crankshaft 82 so one complete turn has been achieved.

The cylinder piston and booster units work together in the manner earlier described such that timer control 103 cycles repeatedly and the cranks shaft moves continually in a typical two-cycle engine operation. Nothing further need be described herein since such an operation will readily be clear to those of ordinary skill in this art from that which has been described herein.

Figure 28:
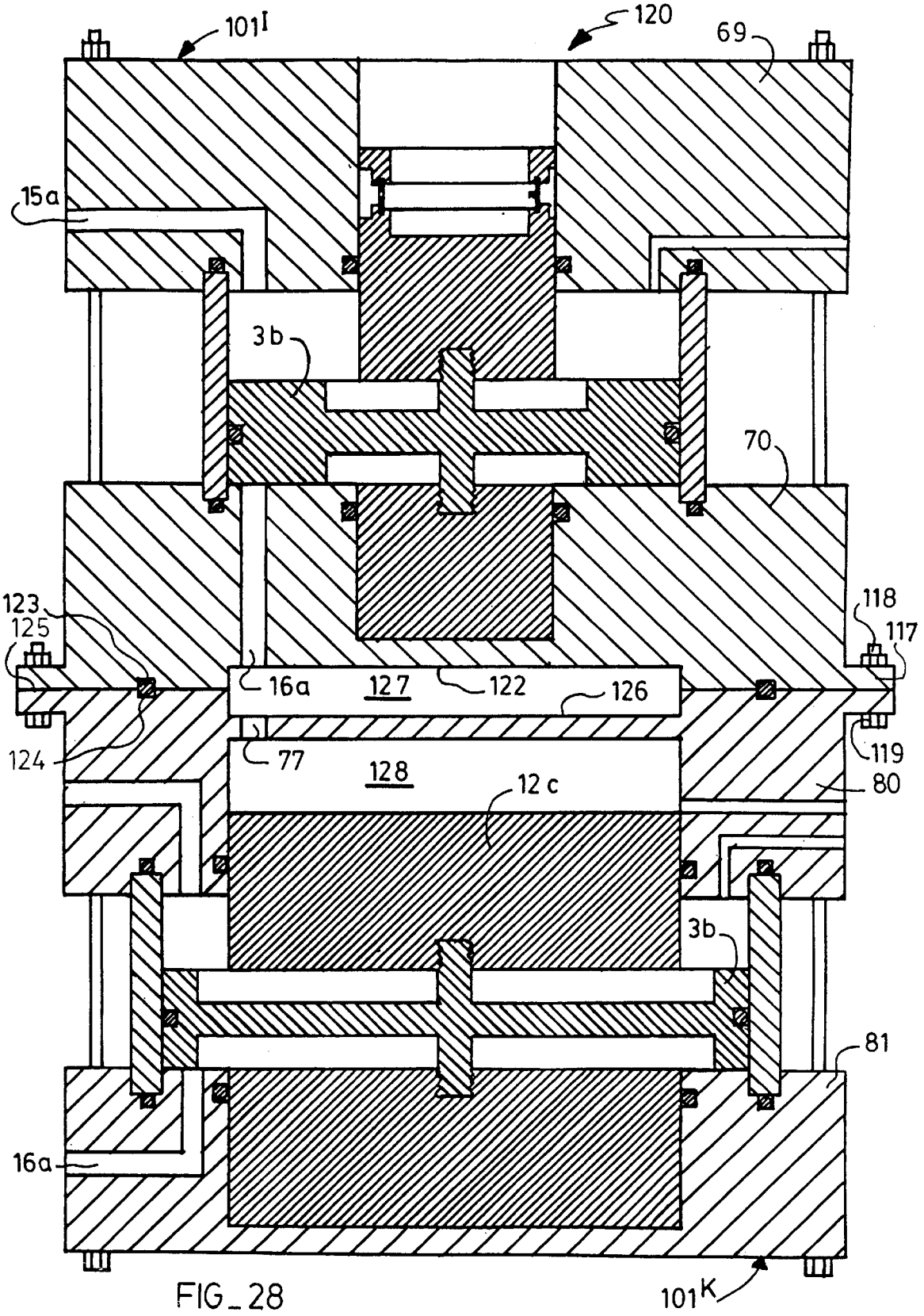

FIG. 28 shows a hydraulic cylinder of the present invention shown in FIG. 20 type 1*i* shown joined together by flanges generally indicated as 117 and bolts generally indicated as 118 and bolt nuts generally indicated as 119. Joined with the cylinder is my booster invention of the FIG. 23 type 1L. Cap 70 of hydraulic cylinder 1*i* has flanges 117, an O-ring seal 123 mounted in a recess 124 in the face 121, which has a recess 122 forming one half of a distribution chamber 127. Port 16*a* communicates from distribution chamber 127 to hydraulic cylinder 1*i*/101*i*.

Chamber 127 spans both the cylinder housing and the booster housing and they are joined side by side to the end face 125 of the head 80 of booster 1L which has a similar recess 126 to recess 122 of hydraulic cylinder 1*i*. Exit port 77 of the pressure chamber 128 of booster 1L and the inlet port 16*a* of the hydraulic cylinder 1*i*. Fluid at low pressure enters the inlet port 16*a* of booster 1L and pushes piston 3*b* shown here in a retracting position. Chamber 128 creates an intensified fluid at higher pressure which exhausts through exit port 77 inside the distribution chamber 127 then enters the inlet port 16*a* of the hydraulic cylinder 1*i* to advance piston 3*b*.

Figure 29:
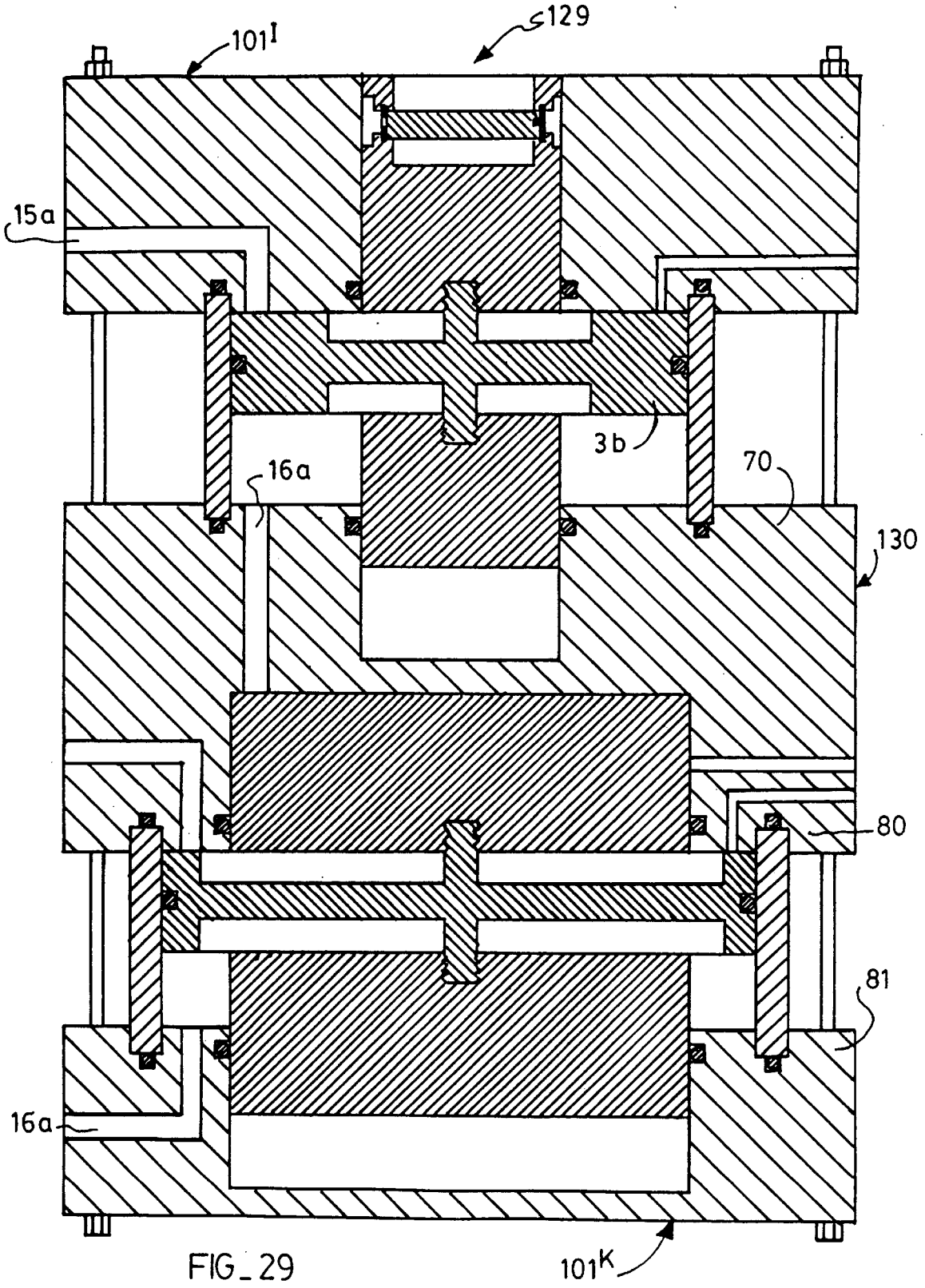
FIG. 29 is a sectional side elevation view of a hydraulic cylinder and booster of the present invention installed as one piece in a retracting position, but without a distribution chamber in between the hydraulic and the booster.

FIG. 29 shows a hydraulic cylinder type 1*i* shown in FIGS. 20 and 28 joined together with a booster type 1L shown in FIG. 23 and FIG. 28 to form one piece 129 similar to piece 120 of FIG. 28. But in FIG. 29, the piece 129 does not have a distribution chamber in between the hydraulic cylinder and the booster. Also, the cap 70 of the hydraulic cylinder type 1*i* and the head 80 of the booster type 1L are joined together in one piece 130. Also the exit port 77 of the booster is extended to the inlet port 16*a* of the hydraulic cylinder, but still piece 129 function basically in similar manner as piece 120 shown in FIG. 28.

Figure 30:
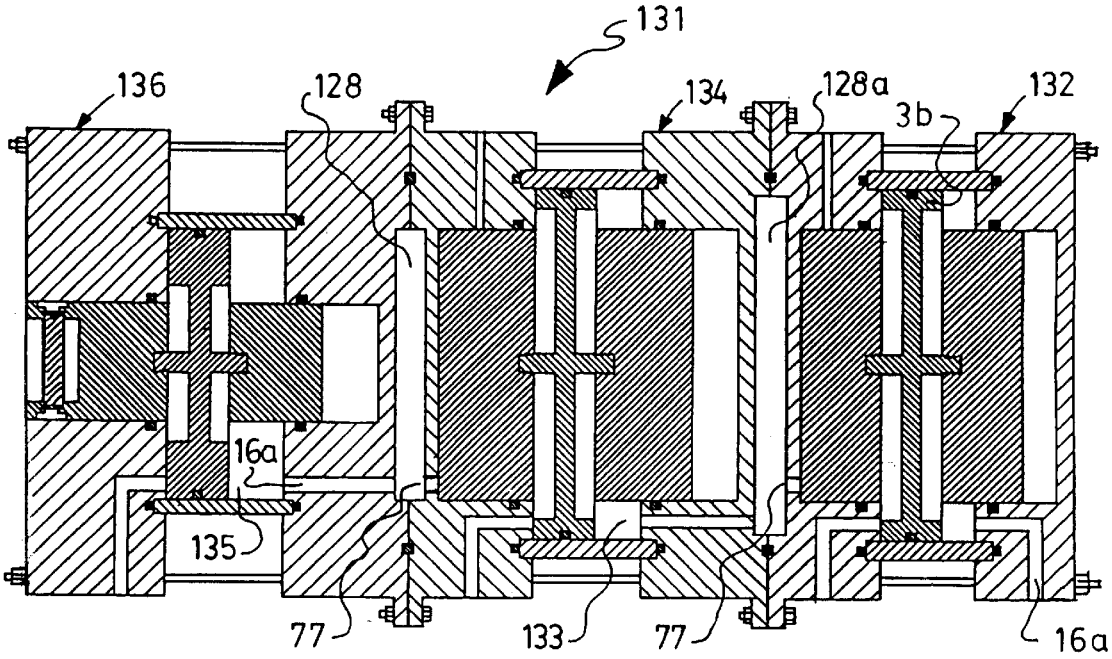
FIG. 30 shows a sectional side elevation view of a hydraulic cylinder and two boosters of the present invention installed as one piece and shown in advancing position.

As shown in FIG. 30, a hydraulic cylinder type 1*i* shown in (FIGS. 20/28) is joined by two boosters type 1L to form all together one booster/piston unit 131. The individual cylinder inventions all function in the same manner as earlier described. An element by element comparison is evident. Thus for the cylinder units invention of FIGS. 29 and 30, no further detailed description is believed to be necessary.

While my invention has been described with reference to a particular example of preferred embodiments, it is my intention to cover all modifications and equivalents within the scope of the following claims. It is therefore requested that the following claims, which define my invention, be given a liberal interpretation which is within the spirit and scope of my contribution to this art.

What is claimed is:

1. A pressure-driven cylinder having a housing which includes therein a piston with a piston face, which piston slides between a pair of opposed side end walls that form a sealed piston chamber, inlet and outlet ports in the chamber located on opposite sides of said piston in order to selectively deliver and/or exhaust from the chamber's interior a pressurized piston-driving fluid, a rod operatively connected to one side of said piston and sealably extending outside said cylinder housing to do external work, said pressure-driven cylinder comprising:

a slidable part of at least one of said chamber side end walls integrally connected to and axially spaced away from said piston face by an integral physical connection point on said piston face;

said connection point being much smaller in area than the piston's pressure face and also having an area that is less than the cross-sectional area of the slidable part of the end wall;

said slidable part of the end wall of said chamber having a cross-sectional area smaller than the pressure area of the piston and acting as an integral piston follower;

said follower itself having a volume-occupying body selected to reduce the amount of fluid during reciprocation, as a single integral unit, of the piston, piston follower and connection point all sliding together inside the chamber; and means slidably sealing the piston follower in the cylinder housing so that the follower body may slide into the piston chamber as said single unit slides in response to pressure applied at said pressure inlet port of said chamber.

2. A pressure-driven cylinder in accordance with claim 1 wherein said end wall is an extension of said cylinder housing and said cylinder further comprises:

ring seals as said sealing means for the piston follower so that the pressurized driving fluid remains in the piston chamber alone as said follower slides into the chamber and reduces the chamber volume.

3. A pressure-driven cylinder in accordance with claim 1 wherein an annular channel is provided in said face of said piston as an additional fluid depth for the driving fluid.

4. A pressure-driven cylinder according to claim 1 with the integral connection point of a smaller diameter than the diameter of the piston follower, said cylinder further comprising:

a stem part extending between said piston face and said slidable part of said end wall for integrally connecting said piston and follower together as a single sliding unit.

5. A pressure-driven cylinder according to claim 1, wherein the means for connecting the piston with said slidable part of the end wall further comprises:

a flexible connection extending between said piston face and said end wall follower for integrally connecting said piston and follower together as a single sliding unit.

6. A pressure-driven cylinder according to claim 3 wherein said driving fluid is hydraulic and said annular channel is further defined as having a surface comprising:

an inner peripheral surface of the annular channel which extends radially outward and spaced from said end wall follower to thereby define an annular port whereby the hydraulic fluid acts against substantially the entire face of said piston.

7. A pressure-driven cylinder having a housing which includes therein a piston with a double-sided piston face, which piston slides between a pair of opposed side-end walls that form a sealed piston chamber in the housing, inlet and outlet ports in the chamber located on opposite sides of said piston in order to selectively deliver and/or exhaust from the chamber's interior a pressurized piston-driving fluid, said pressure-driven cylinder comprising:

a slidable part of each one of said pair of chamber end walls integrally connected to and axially spaced away from each side of said piston by a pair of integral physical connection points of much smaller area than the piston's pressure face and also having an area smaller than the slidable part of the side end wall;

said connection point being much smaller in area than the piston's pressure face and also having an area that is less than the cross-sectional area of the slidable part of the end wall;

each slidable part of the end wall of said chamber acting as an integral double-sided piston follower, with each follower having an end remote from the connection point;

said double-sided follower itself having a volume-occupying body selected to reduce the amount of fluid during reciprocation of the piston as the piston, double-sided piston follower and double-sided connection point slide together as a single unit inside the chamber; and means slidably sealing the pair of slidable piston followers in the cylinder housing.

8. A pressure-driven cylinder in accordance with claim 7 and further having a rod sealably extending outside said cylinder housing to do external work, said cylinder further comprising:

means connecting the rod to one of said piston followers at its remote end such that the rod is moved externally as the single unit piston and double-sided follower pair reciprocate in the chamber.

9. A pressure-driven cylinder in accordance with claim 7 and acting as a booster, which cylinder further comprises a booster pressure chamber located in one of the side end walls:

a slidable ram connected to the remote end of said selected follower to be driven by said slidable single unit inside said booster pressure chamber;

said ram having a smaller diameter than the piston to intensify the pressure of fluid in said booster pressure chamber when the ram slides inside the pressure chamber; and said booster pressure chamber having an intake port to receive fluid at low pressure and an outlet port for exhausting fluid at a high pressure from said booster pressure chamber.

10. A pressure-driven cylinder in accordance with claim 7 wherein each of said followers are slidably mounted in a pair of pockets, with one pocket each located in one side end wall, said housing being defined by a hollow cylindrical tube forming a chamber by use of an end cap and a head cap secured to said cylindrical housing tube by tie rods, said cylinder further comprising:

a pair of pockets for slidably housing each of said followers, wherein one pocket is located in the head cap and one pocket is located in the end cap;

each pocket in said caps having equal depths, with the depth into the caps being deeper than the stroke length and ending at a pocket bottom;

said one follower acting as a ram for pressure intensification as it travels a stroke depth which is also equal to the depth of the booster pressure chamber for that follower;

the depth of the booster pressure chamber is defined by the stroke length as measured from the pocket bottom to the point of the remote end of the selected follower when the piston is at its full retracting position; and said pocket having an intake port to receive fluid at low pressure and an outlet port for exhausting fluid at a high pressure from said booster pressure chamber.

11. A pressure-driven cylinder in accordance with claim 7, which cylinder further comprises;

a tubular extension at the remote end of said one selected follower having a pin across the extension secured by two holes recessed into the wall of said tubular extension;

a connecting rod having a first and second end;

a crankshaft adapted for rotation;

said pin forming a pivot means connecting the first end of said connecting rod to said follower and the second end of said rod to said crankshaft in order for translating the linear movement of said pressure driven cylinder to a rotary movement of said crankshaft.

12. A pressure-driven cylinder in accordance with claim 11, which cylinder is in a hydraulic circuit interconnected with a pressure-driven booster and further comprises;

said booster and hydraulic cylinder forms a first assembly for applying a half turn on said crankshaft;

another similar booster and similar hydraulic cylinder forms a second assembly for applying another succeeding half turn on said crankshaft;

in both said first and second assemblies the volume of the booster pressure chamber is equal to the volume of the cylinder chamber, where fluid exhausted entirely from the booster pressure chamber after a complete advancing stroke will fill entirely the cylinder piston chamber;

a four-way control valve controlling both first and second crankshaft-turning assemblies;

which control valve has first and second control positions;

a solenoid operable to effect either one of said positions;

a two-way valve to establish a filling procedure prior to operation of any of such said positions; and hydraulic supply means for circulating hydraulic fluid to said two assemblies under control of said valves such that the crankshaft is turned through complete revolutions.

13. A pressure-driven cylinder in accordance with claim 11 wherein said cylinder is a first cylinder in a first housing and said first cylinder housing is joined to a booster housing to form a unitary housing unit, and said unitary housing unit further comprises:

a distribution chamber formed in equal recesses between the first and second housings at the flanged part thereof;

an outlet port for communicating fluid from the booster pressure chamber to said distribution chamber; and an inlet port for communicating fluid from said distribution chamber to the piston chamber of said first cylinder.

14. A pressure-driven cylinder in accordance with claim 11 wherein said cylinder is a first cylinder in a first housing and said first cylinder housing is joined to a booster housing to form a unitary housing unit, and said unitary housing unit further comprises:

volume of the booster pressure chamber is equal to the volume of the piston chamber, where fluid exhausted entirely from the booster chamber after a complete advancing stroke will fill entirely the piston chamber and advances the piston of said first cylinder one complete advancing stroke.

15. A pressure-driven cylinder in accordance with claim 11 wherein said cylinder is a first cylinder in a first housing and said first cylinder housing is joined to a booster housing by a center cap that is cap that is shared in common by both said cylinder and said booster, and said common center cap further comprises:

an outlet port communicating fluid from the booster pressure chamber to said inlet port for the piston chamber of said first cylinder.

16. A pressure-driven cylinder in accordance with claim 11 wherein said cylinder is a first cylinder in a first housing and said first housing is joined to another second cylinder housing by flanges, said second housing comprising two or more booster cylinders in one integral unit, and further comprising:

a distribution chamber formed between each one of said two or more booster housings with;

an outlet port from the first booster pressure chamber for communicating fluid from the first booster pressure chamber to a first distribution chamber;

an inlet port connecting said first distribution chamber to the inlet side of a second booster chamber, and said port connections being repeated for each succeeding booster in the integral unit;

the volume of the first booster pressure chamber is equal to the volume of the second booster chamber, where fluid exhausted entirely from the first booster pressure chamber after a complete advancing stroke will fill entirely the second booster piston chamber and advances the piston of said second booster one complete advancing stroke;

the volume of second booster pressure chamber is equal to the volume of the first cylinder piston chamber where fluid exhausted entirely from the second booster pressure after a complete advancing stroke will fill entirely the first cylinder's piston chamber advancing its piston of said first cylinder one complete advancing stroke; and an inlet port interconnecting the second booster into said first hydraulic cylinder.

17. A pressure-driven cylinder in accordance with claim 11 and further comprising:

rotatable connections at each end of said connecting rod of each cylinder for translating reciprocating piston movement of such cylinders into a rotary movement outside such cylinder(s);

means slidably sealing the pair of slidable pistons followers in the cylinder housing so that the follower pair may slide into and out of the piston chamber as the piston slides in response to fluid pressure at an inlet port;

at least one selected one of certain followers of such cylinders having a tubular extension at the remote end of said one selected follower having a pin across the extension secured by two holes recessed into the wall of said tubular extension;

a connecting rod having a first and second end;

a crankshaft adapted for rotation;

said pin forming a pivot means connecting the first end of said connecting rod to said follower and the second end of said rod to said crankshaft in order for translating the linear movement of said pressure driven cylinder to a rotary movement of said crankshaft.

18. A pressure-driven cylinder having a housing which includes therein a piston with a double-sided piston face, which piston slides between a pair of opposed side-end walls that form a sealed piston chamber in the housing, inlet and outlet ports in the chamber located on opposite sides of said piston in order to selectively deliver and/or exhaust from the chamber's interior a pressurized piston-driving fluid, said pressure-driven cylinder comprising:

a slidable part of each one of said pair of chamber end walls integrally connected to and axially spaced away from each side of said piston by a pair of integral physical connection points of much smaller area than the piston's pressure face and the slidable part of the side end wall;

said slidable end wall parts of said chamber forming a leading surface of an opposed pair of integral piston followers, with one follower each located on each side of said piston and having a predetermined impervious surface area that includes the surface area of the slidable end wall part of the chamber;

means slidably sealing the pair of slidable piston followers in the cylinder housing so that the follower pair may slide into and out of the piston chamber as the piston slides in response to fluid pressure at an inlet port;

a tubular extension at the remote end of said one selected follower having a pin across the extension secured by two holes recessed into the wall of said tubular extension;

a connecting rod having a first and second end;

a crankshaft adapted for rotation;

said pin forming a pivot means connecting the first end of said connecting rod to said follower and the second end of said rod to said crankshaft in order for translating the linear movement of said pressure driven cylinder to a rotary movement of said crankshaft.

* * * * *